US005807225A

United States Patent [19]

Nowacki et al.

[11] Patent Number: 5,807,225

[45] Date of Patent: Sep. 15, 1998

[54] APPARATUS FOR FABRICATING PAPERBOARD PACKAGING

[75] Inventors: Ulrich Gerd Nowacki, Homestead; Guillermo Rojas, Miami, both of Fla.; William John Baird, Indianapolis, Ind.

[73] Assignee: Inland Paperboard and Packaging, Inc., Indianapolis, Ind.

[21] Appl. No.: 594,288

[22] Filed: Jan. 30, 1996

[51] Int. Cl.[6] ..... B31B 1/44; B65H 45/18

[52] U.S. Cl. ..... 493/167; 493/171; 493/130; 493/142; 493/143; 493/144; 493/177

[58] Field of Search ..... 493/130, 131, 493/132, 141, 142, 143, 144, 147, 167, 177, 178, 254, 405, 416, 175

[56] References Cited

U.S. PATENT DOCUMENTS

| | | | |
|---|---|---|---|
| 2,189,105 | 2/1940 | Evans . | |
| 2,982,188 | 5/1961 | Von Hofe | 493/167 |
| 3,800,681 | 4/1974 | Corderoy | 493/167 |
| 3,952,634 | 4/1976 | Rollins | 493/171 |
| 4,624,653 | 11/1986 | McBride | 493/131 |
| 5,024,641 | 6/1991 | Boisseau | 493/167 |
| 5,177,930 | 1/1993 | Harston | 493/167 |
| 5,487,504 | 1/1996 | Baird | 229/120 |

*Primary Examiner*—Jack W. Lavinder
*Attorney, Agent, or Firm*—Fitch, Even, Tabin & Flannery

[57] ABSTRACT

Automated apparatus for forming paperboard packaging from an integral paperboard blank includes a blade for gathering a central portion of the paperboard blank, causing the width of the blank to contract. A reciprocating mandrel rams the blank into a hollow tubular former having an opening of reduced size, causing portions of the blank to form side walls properly positioned with respect to a floor portion of the blank. Pistons within the mandrel apply pressure to overlapping portions of the formed blank, to seal those portions together.

18 Claims, 20 Drawing Sheets

APPARATUS FOR FABRICATING PAPERBOARD PACKAGING

BACKGROUND OF THE INVENTION

1. Field of the Invention

The present invention pertains to apparatus for fabricating paperboard packaging, and in particular to packaging comprising an open top paperboard tray.

2. Description of the Related Art

In the past, individual items of manufacture, even when shipped in significant numbers, were placed in individual packaging which was then inserted in an outer container. In an effort to reduce packaging costs, manufacturers have considered eliminating double packaging, relying on a single, outer package to protect the contents during shipment. Accordingly, interest has arisen in containers having increased strength sufficient to eliminate the need for double packaging.

Manufacturers of paperboard containers have long sought to enjoy economies of scale, by pursuing efficient automated equipment for manufacturing paperboard containers. Over the years, a variety of different machines have been proposed and, with varying degrees of human intervention from either a machine operator or off-line assembly personnel, older equipment has been employed for the fabrication of newly evolving paperboard packages. However, efficiency, flexibility in meeting changing customer demands and other business competitive advantages may be sacrificed.

SUMMARY OF THE INVENTION

It is an object of the present invention to provide apparatus for fabricating paperboard packaging.

Another object of the present invention is to provide apparatus for the automated fabrication of a particular paperboard container from an integral paperboard blank, the container comprising:

an enclosure of paperboard material made from an integral, one-piece blank, including a floor, front and rear walls upwardly extending from opposite ends of the floor, opposed side wall panels between the front and rear walls which extend upwardly from the floor above the front and rear walls, and vertical beam members extending from the sidewall panels toward one another and cooperating with the side wall panels to form side walls of generally T-shaped cross section; and the side wall panels and vertical beams having respective upper ends.

A further object of the present invention is to provide apparatus for fabricating a paperboard container from a blank made from an integral, single piece of paperboard material which is folded to form a container including a floor, front and rear walls upwardly extending from opposite ends of the floor, opposed side wall panels between the front and rear walls which extend upwardly from the floor above the front and rear walls, and vertical beam members extending from the side wall panels toward one another and cooperating with the side wall panels to form side walls of generally T-shaped cross section, the blank comprising:

two outer columns comprising mirror images of one another;

a internal column between the two outer columns;

the internal column comprising a serial succession of at least one front panel, a first floor panel, a first internal divider panel, a second divider panel, a second floor panel and at least one rear panel;

the outer columns each comprising a serial succession of a forwardly facing panel, a first side wall panel, a first vertical beam panel, a second vertical beam panel, a second side wall panel and a rearwardly facing panel;

and the first and the second divider panels joined together by a first fold line, and the first and the vertical beam panels joined together by a second and a third fold line, respectively, lying on opposite ends of the first fold line in generally colinear relationship therewith.

These and other objects of the present invention are provided in apparatus for forming a carton from a paperboard blank having an interior portion with first and second parts and four outside corners, the apparatus comprising:

a conveyor for moving the blank along a direction of travel;

a blade on one side of the conveyor and having a length extending along the direction of travel, the blade movable toward and away from a blank carried on the conveyor;

means for moving the blade to push the interior portion of the blank, bringing the parts of the interior portion of the blank into overlying relationship;

a sealing section adjacent the conveyor for pressing the overlying parts together;

a carton-forming station;

a hollow form at the carton-forming station, on one side of the conveyor means, the hollow form defining a passageway for receiving a forming mandrel;

a forming mandrel at the carton-forming station, on the other side of the conveyor means, opposite the hollow form, the forming mandrel mounted for movement toward and away from the hollow form; and mandrel operating means for pushing the forming mandrel into the hollow form to thereby plunge the blank into the hollow form.

DETAILED DESCRIPTION OF THE PREFERRED EMBODIMENTS

Figure 1:
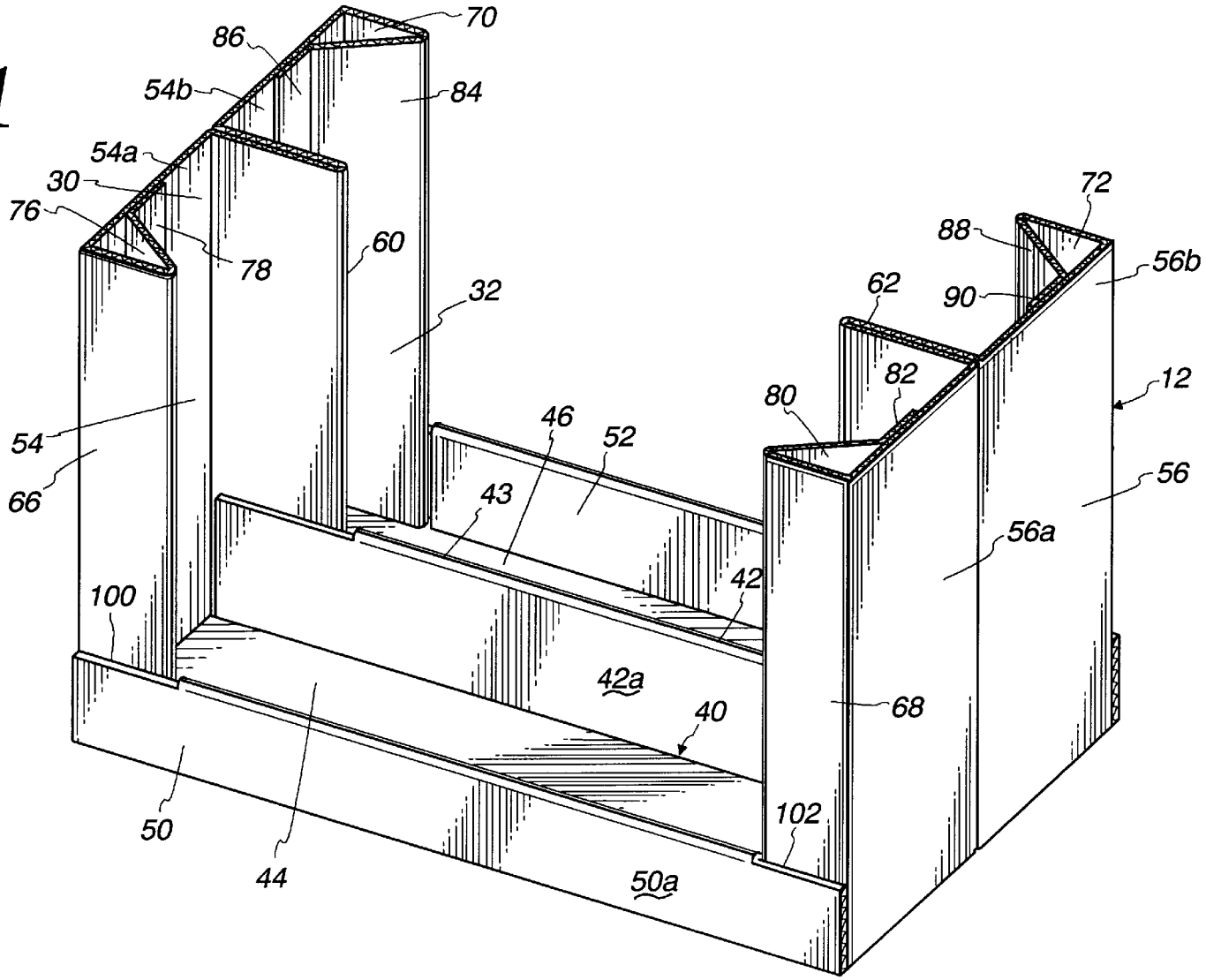
FIG. 1 is a perspective view of a packaging container constructed with apparatus according to the present invention.
Figure 3:
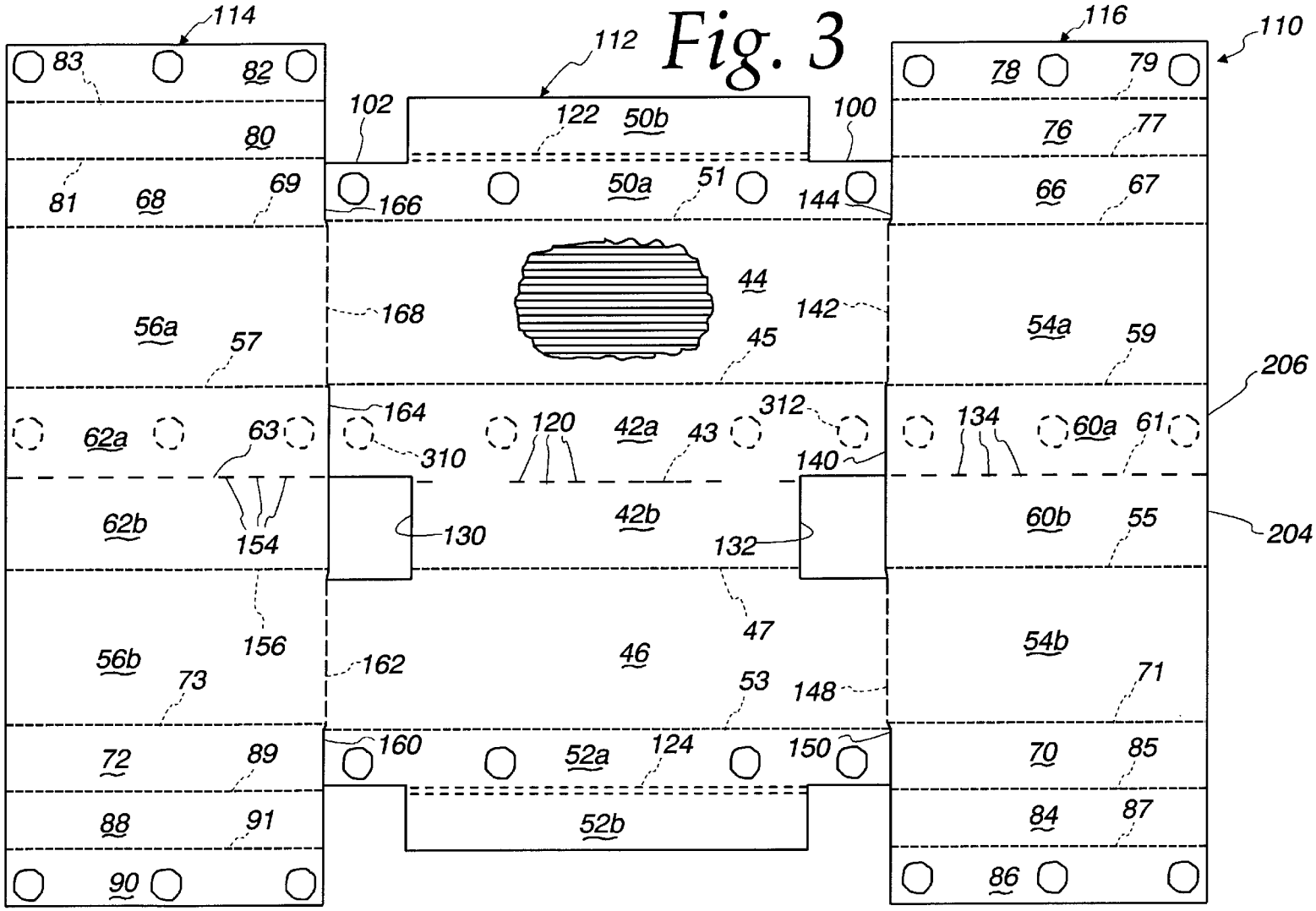
FIG. 3 is a top plan view of a paperboard blank from which the container of FIG. 2 is formed.

Referring now to the drawings, and initially to FIG. 1, a container generally indicated at 12 is preferably formed from an integral one-piece blank (shown in FIG. 3). The container 12 is shown in a dual compartment configuration, although the container can also be configured to have a single compartment or alternatively, three or more compartments. In the preferred embodiments, the container 12 is of rectangular construction, although other configurations are also contemplated.

The container 12 includes first and second compartments 30, 32 of substantially identical construction, except for the lower divider wall, as will be explained herein. The container 12 includes a floor generally indicated at 40, preferably formed of a single paperboard panel which is folded in the middle to form a divider wall or internal beam 42, located between floor sections 44, 46. Upstanding front and rear lower walls 50, 52 extend generally parallel to beam wall 42.

Container 12 further includes multi-section side walls 54, 56. The side wall 54 includes side wall sections 54*a*, 54*b* extending generally parallel to one another and preferably lying in a common plane. Similarly, the side wall 56 is comprised side wall sections 56*a*, 56*b*, which are also arranged coplanar to one another. Upstanding divider walls or internal beams 60, 62 are generally parallel to one another, lying in generally coplanar relationship with the lower, or internal beam wall 42. The preferred carton, therefore, has a single multi-section beam wall, the sections of which are joined together by adhesive, as will be seen. The internal beam sections are shown centered in container 12, but they can also be non-centered, as where three objects are to be carried side-by-side.

The internal beam walls 42, 60, 62 preferably comprise folded portions of a paperboard blank which are located between the side wall sections and integrally formed therewith to comprise, in effect, a T-shaped beam. Upstanding forwardly facing front panels 66, 68 extend from side walls 54, 56, respectively, and are preferably arranged generally coplanar with lower wall 50. Similarly, upstanding rearwardly facing rear panels 70, 72 are arranged generally coplanar with lower wall 52. In the preferred embodiment of container 12 shown in FIG. 1, a corner post comprising corner panels 76, 78 cooperate with front wall 66 and side wall 54 to form an open channel of generally triangular cross section. Similarly, corner post panels 80, 82 cooperate with upstanding side wall 68 and side wall section 56*a* to form a corner post having a hollow, triangular cross section. Panels 84, 86 cooperate with rear panel 70 and side wall section 54*b* to form a corner post, also of generally hollow, triangular cross section.

Figure 2:
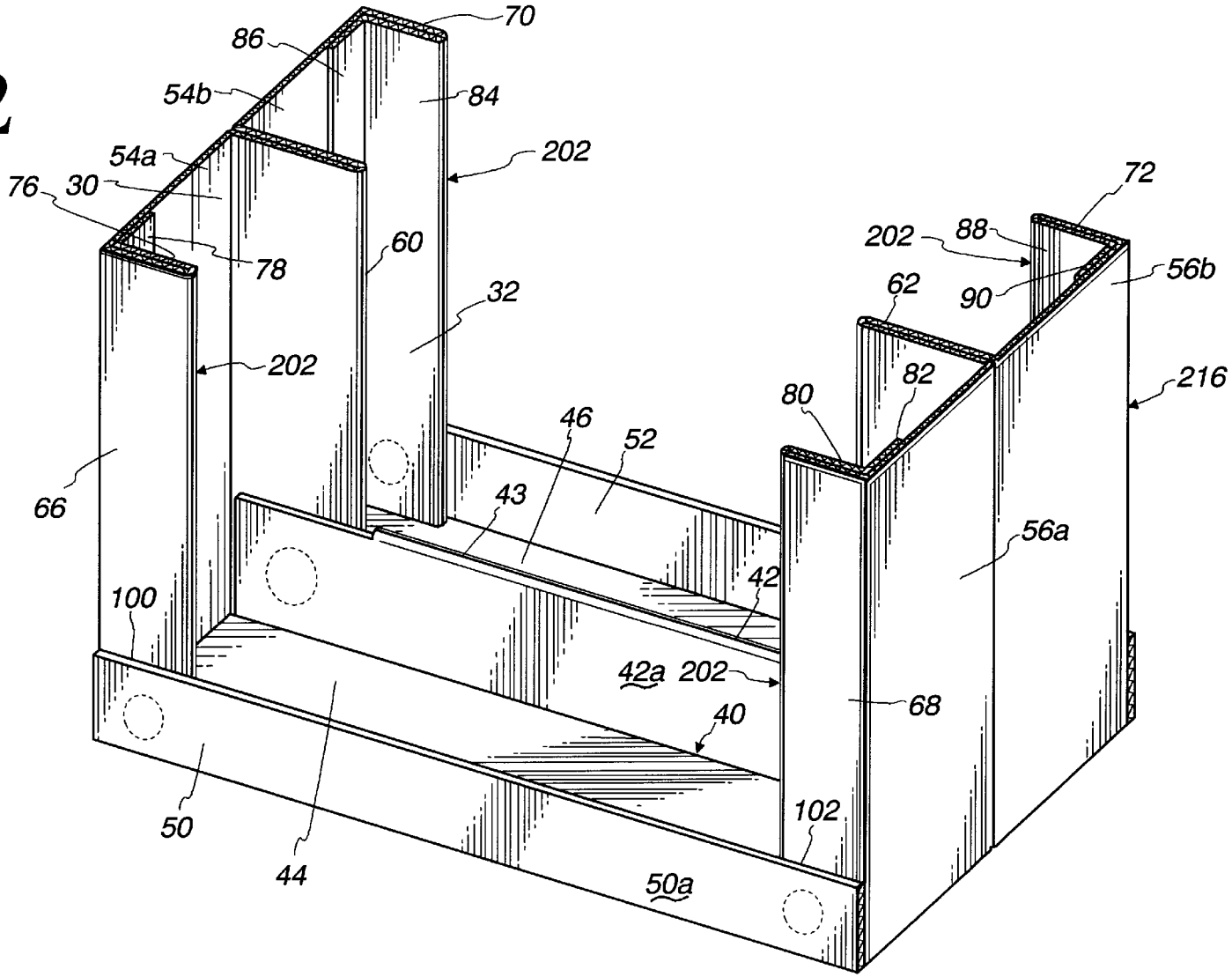
FIG. 2 is a perspective view of alternative paperboard container construction, fabricated with apparatus according to principles of the present invention.

Finally, corner brace panels 88, 90 cooperate with rear panel 72 and side wall section 56*b* to form a corner post of hollow, triangular cross section. Alternatively, the container can be provided with rectangular corner posts (i.e. L-shaped in cross-section as shown in FIG. 2 ), the corner post pairs 76, 78; 80, 82; 84, 86; and 88, 90 can be omitted, if desired. As will be appreciated by those skilled in the art, the corner posts formed at each corner of container 12 contribute significantly to the stacking strength of the container and can readily support relatively heavy weights placed on top of the container. The internal beam walls 60, 62 also function as post members, contributing significantly to the stacking strength of the container side walls.

As shown in the Figures, the upstanding side walls, corner posts and internal beam constructions preferably terminate in an upper, common plane, so as to provide a convenient supporting surface, for other items such as other cartons stacked on top of container 12. As mentioned above, it is desirable that a container be able to accommodate a wide variety of products. As will be seen herein, the container of the present invention can be readily modified to accommodate products of different proportions. For example, the side walls, corner posts and internal beams can be extended considerably beyond the height shown in FIGS. 3 and 4, for example, without requiring heavier gauge paperboard to maintain a desired stacking strength. Thus, the same container can be extended in height to accommodate products such as glass bottles which have a height much greater than their cross-sectional dimensions, allowing the bottles to stand upright within the container.

Also, the same container can be modified to accommodate different packaging configurations for a product. For example, a container with relatively short side walls can be used for small lunch box-sized bags of potato chips, for example, with several such packs being loaded in each compartment of the container. The same container can be modified to have side walls of extended height so as to accommodate a single family-size package of potato chips in each compartment. The design for these two containers can be made virtually identical, except for a change in the side wall height. A substantial cost savings to a carton manufacturer can be enjoyed with the present invention.

As can be seen from examining the preferred embodiments shown in the Figures, the containers of the present invention provide an attractive display. Upon arrival at a store, the container 12 is ready to be placed on a shelf, making an attractive presentation of products carried inside the container. Further, the front and rear walls help to maintain contents of the container in a desired upright orientation, thus conserving shelf space, especially for products such as small bags of potato chips which are not self standing. Preferably, the floor sections 44, 46, interior wall 42 and the front and rear walls 50, 52 are formed from a continuous strip of corrugated material which is folded several times to form the three upstanding walls 42, 50, 52. Each of these upstanding walls 42, 50 and 52 are of double thickness construction. If desired, the rear walls 50, 52 can be made single thickness (i.e. with panels 50*b*, 52*b* omitted), as illustrated in FIG. 2

FIG. 2, as mentioned above shows a slightly modified carton, which is identified by the reference numeral 216. The corner posts are L-shaped and the end walls have a single layer thickness. With minor modifications, the blank 110 of FIG. 3 can be used to form the carton 216.

Turning now to FIG. 3, a paperboard blank is generally indicated at 110. The carton blank 110 includes a internal column 112 located between outer columns 114, 116. Generally speaking, the floor sections and upstanding walls 42, 50, 52 are formed from the internal column 112, while the side walls, internal beams and corner posts are formed from the outer columns 114, 116. The inside surfaces of container 12 are visible in FIG. 3. The carton blank 10 can be used to form the carton of FIG. 1 or of FIG. 2 with the omission of end wall panels 54*a*, 56*a* as will be seen, and with slight drifting of the fold lines of the corner post panels.

The internal column 112 of blank 110 includes a center line (which is also, preferably, a line of symmetry) comprising fold line 43 joining adjacent divider panels 42*a*, 42*b* and including a series of perforations 120 to aid in folding. The perforations 120 have been omitted in the other figure for clarity of illustration. Panels 42*a*, 44 are joined by a fold line 45, preferably formed by scoring the paperboard blank 110. A fold line 47 joins adjacent panels 42*b*, 46, and is also formed by scoring the paperboard blank. Adjacent panels 44, 50*a* are joined by a fold line 51 formed by scoring blank 110. Front panels 50*a*, 50*b* are joined by a fold line 122. Adjacent panels 46, 52*a* are joined by score-type fold line 53, while adjacent rear wall panels 52*a*, 52*b* are joined by a double score line 124.

In fabricating the container, fold line 45, 47 are brought together with score line 43 being raised from the plane of blank 110. This brings the hidden underside surfaces of panels 42*a*, 42*b* together, and a suitable adhesive is employed to maintain their abutting joinder. Panel 50*a* is raised out of the plane of blank 110, being folded about fold line 51. The sides of panels 50*a*, 50*b*, visible in FIG. 9, are folded against one another and secured with a suitable adhesive. Similarly, the upper surfaces of panels 52*a*, 52*b* are secured together with adhesive to form upstanding wall 52, which is raised in an upstanding position by folding about line 53. Generally rectangular shaped holes 130, 132 are formed at either end of panel 42*b*. These holes, which also extend slightly into adjacent panels 46, accommodate the internal beams 60, 62, so as to minimize thickness variations in the internal of the container.

Turning now to the right hand column 116, adjacent panels 60*a*, 60*b* are joined together along perf line 61, which includes a series of spaced perforations 134. Adjacent panels 54*b*, 60*b* are joined together along a fold line 55 while adjacent panels 54*b*, 70 are joined together by a fold line 71. Panels 70, 84 are joined together by a fold line 85, and panels 84, 86 are joined together by a fold line 87. Fold lines 55, 71, 85 and 87 are lined to indicate a preferable construction which includes a larger number of smaller sized perforations to aid in folding. Turning now to the remaining half portion of outer column 116, panels 60*a*, 54*a* are joined together by a fold line 59, while panels 54*a*, 66 are joined together by a perf line 67. Adjacent panels 66, 76 are joined together by a perf line 77, while panels 76, 78 are joined together by a perf line 79.

In general terms regarding fabrication of container 12, fold lines 55, 47, 156 and 59, 45, 57 are brought together, with fold lines 61, 43, 63 being raised out of the plane of blank 110, to form internal beam walls 60, 42, 62. A cut line 140 divides panels 60*a*, 42*a*. The underside surfaces of panels 60*a*, 60*b* are brought together and secured with a suitable adhesive. Panels 54*a*, 66 are folded at right angles to one another, with panel 66 being raised out of the plane of blank 110. Corner post wall 78 is positioned against side wall panel 54*a* and secured thereto with a suitable adhesive. Panels 44, 54*a* are joined together by a fold line 142, while panels 50*a*, 66 are separated by a cut line 144. Similarly, the panels 46, 54*b* are joined together by a fold line 148, while the laterally adjacent panels 52*a*, 70 are separated by a cut line 150.

A fold line 61 of outer column 116 preferably comprises a line of symmetry. Accordingly, the bottom half of column 116 is assembled as described above, with corner post wall 86 being pressed against side wall panel 54*b*, with panel 70 extending at a right angle to panel 54*b*. Preferably, the corner post panel 86 is secured with a suitable adhesive to panel 54*b*.

Outer column 114 preferably comprises a mirror image of outer column 116 and is assembled in a similar manner. The fold line constructions of outer column 114 are similar to those of outer column 116. In particular, panels 62*a*, 62*b* are joined together by a perf line 63, preferably including a series of spaced apart perf lines 154. Adjacent panels 56*a*, 62 are joined together by a perf line 57, preferably comprised of a larger number of smaller perf cuts than line 63. Adjacent panels 56*a*, 68 are joined by a perf line 69, adjacent panels 68, 80 are joined by a perf line 81 and adjacent panels 80, 82 are joined by a perf line 83. Line 63 is preferably a line of symmetry of outer column 114. Panels 56*b*, 62*b* are joined together by a perf line 156, while panels 56b, 72 are joined together by a perf line, adjacent panels 72, 88 are joined by a perf line 89 and adjacent panels 88, 90 are joined by a perf line 91. Laterally adjacent panels 72, 52*a* are separated by a cut line 160, while laterally adjacent panels 56*b*, 46 are joined by a fold line 162. Adjacent panels 62*a*, 42*a* are separated by a cut line 164, and panels 50*a*, 68 are also separated by a cut line, the cut line 166. Laterally adjacent panels 44, 56*a* are joined by a fold line 168.

During construction, as will be seen, the paperboard blank is folded about the center lines 63, 43 and 61 and "pinched" or "puckered" so as to raise these fold lines out of the plane of the blank. The mating sections on either side of the fold lines 63, 43 and 61 are secured together with a suitable adhesive. The rear panels of the internal column, panels 52*a*, 52*b* and 50*a* and 50*b* are secured together with a suitable adhesive. The constructions formed from the outer columns are then raised to generally upright positions, bringing the beams 60, 62 into contact with end portions of panel 42*a*, so as to be secured thereto with a suitable adhesive. The front and rear walls 50, 52 are then raised into position, in contact with lower portions of the panels 66, 68, 70 and 72. The overlapping joinder panel members at the lower corners of the carton are secured with a suitable adhesive. As can be seen in FIG. 1, the internal beam 62 cooperates with side wall sections 56*a*, 56*b* to form a T-shaped composite member to support vertical loading. The same is also true of the other side of the container, which is mentioned above is preferably a mirror image.

Figure 4:
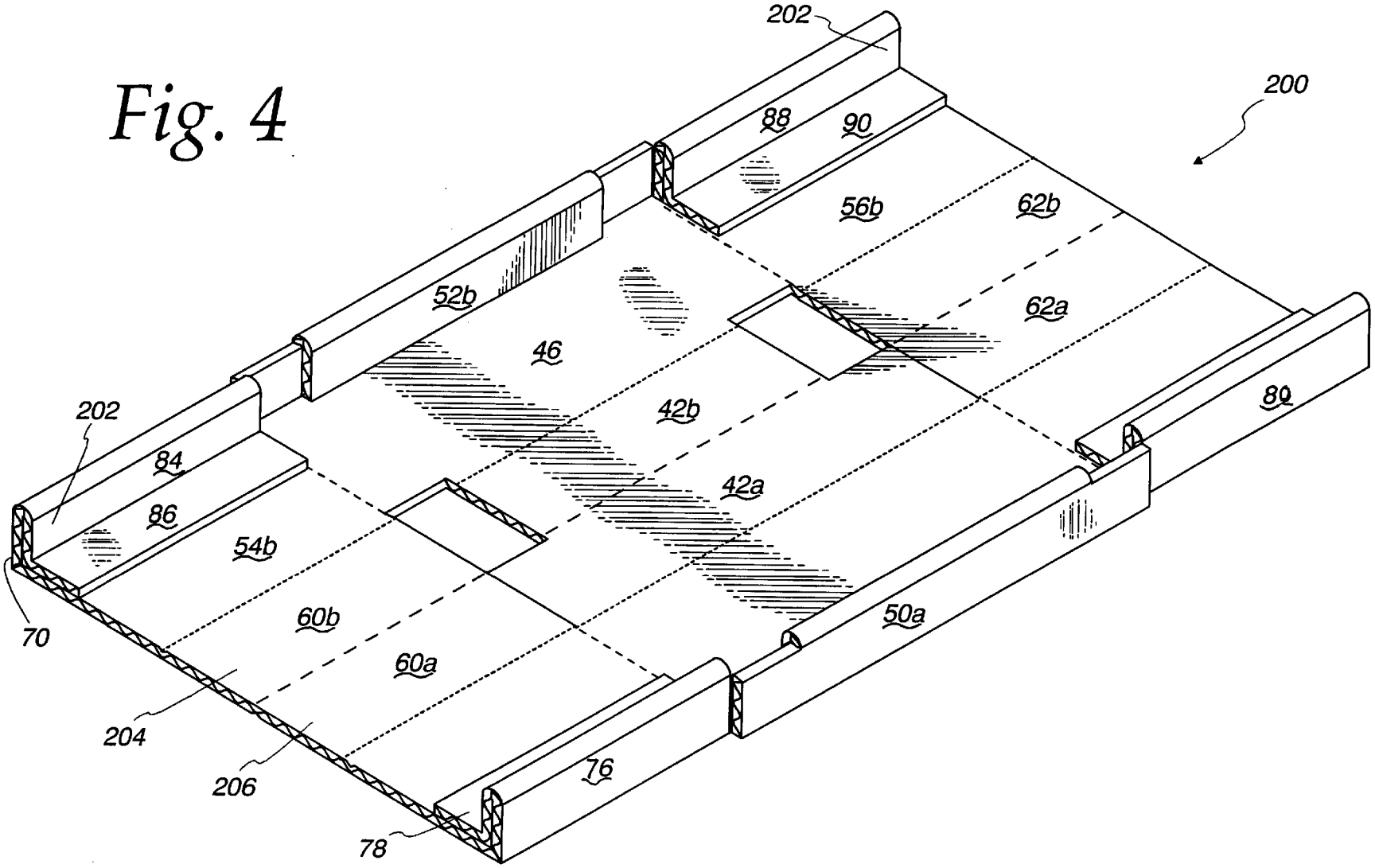
FIG. 4 is a perspective view of the blank of FIG. 3, shown partially formed.

FIG. 4 is a perspective view of a partially formed blank generally indicated at 200 and corresponding to the carton 216 shown in FIG. 2. The partially formed blank 200 is similar to that employed for carton 12 shown in FIG. 1, except that the corner posts 202 are generally L-shaped in cross-section, the panels 50*b*, 52*b* have been omitted, and fold lines for the corner posts have been shifted. The numerals 204, 206 refer to parts of the interior portion of the blank used to form a multisection internal beam. These two internal beam portions 204, 206, are preferably identical to corresponding portions of blank 116 described above with reference to FIG. 3. In particular, internal beam portion 204 comprises portions 60*b*, 42*b*, and 62*b* of the paperboard blank, and internal beam portion 206 comprises portions 60*a*, 42*a* and 62*a* of the paperboard blank of FIG. 3. If desired, the partially formed blank 200 can be fabricated using conventional equipment, such as a corner post machine available from Southern Packaging Machinery Corporation of Florida City, Fla. or a corner post tray former commercially available from R.A. Pearson Company of Spokane, Washington.

Figure 5:
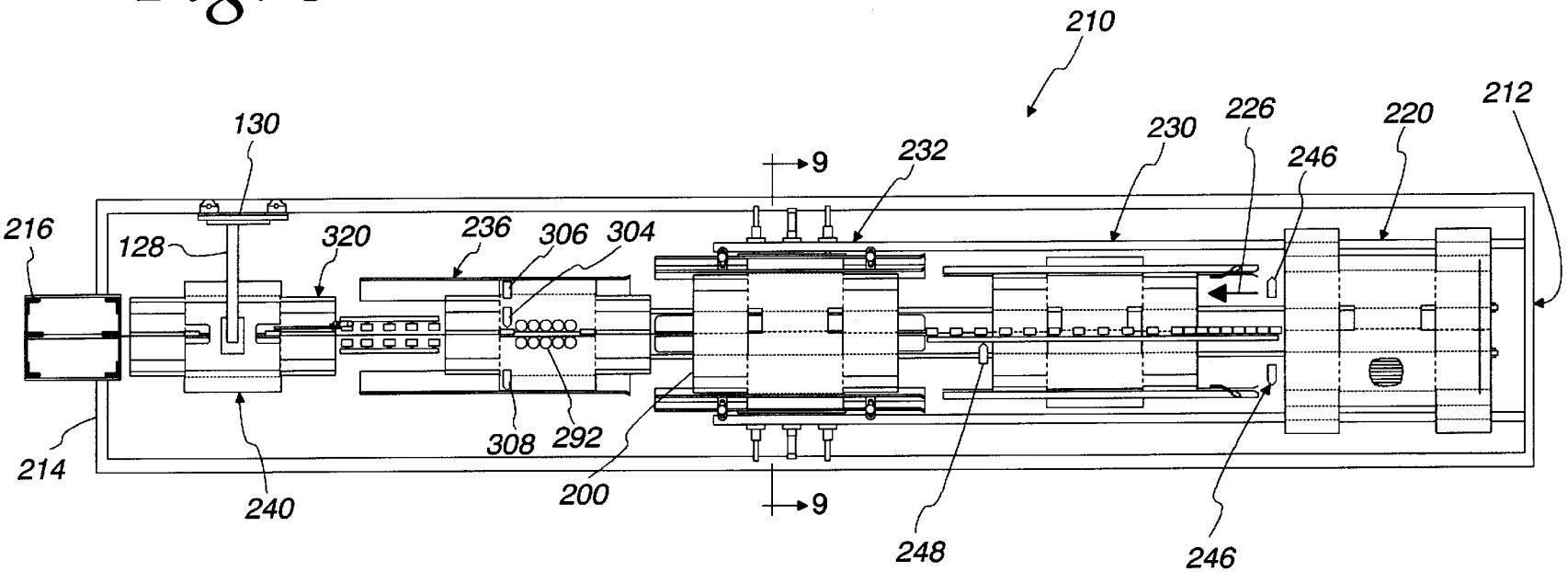
FIG. 5 is a top view of apparatus according to principles of the present invention.
Figure 6:
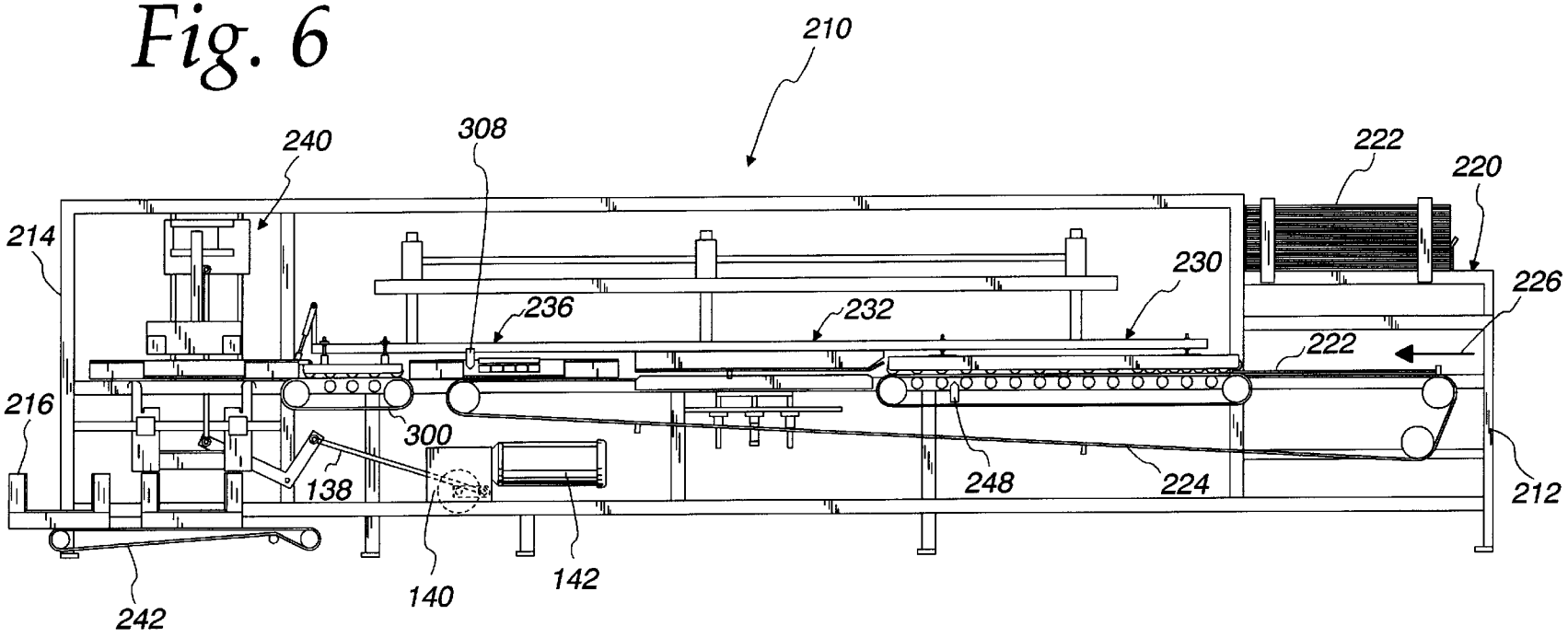
FIG. 6 is a side view thereof.

Referring now to FIGS. 5 and 6, carton forming apparatus illustrating the principles of the present invention is generally indicated at 210. Apparatus 210 has an inlet end 212 and outlet end 214 at which completed cartons 216 are produced. By way of a brief overview, a conventional vacuum loader 220 is located adjacent inlet end 212 and (with reference to FIG. 6) accepts a stack of generally flat paperboard blanks 222, loading the paperboard blanks onto a conventional chain conveyor 224, which conveys the blanks in a direction of feed indicated by arrow 226.

Continuing with the overview, carton blanks are carried from loading station 220 to a corner post-forming station 230 which contains conventional corner post-forming machines, such as those indicated above. The partially formed blank 200 illustrated in FIG. 4 passes from corner post-forming station to an internal beam-forming station 232. As will be seen herein, the internal beam wall-forming station 232 includes apparatus for forming the internal beam-portions of carton 216. The carton blank is then conveyed to a sealing station 236 where additional adhesive is applied to the carton blank, in preparation for subsequent fabrication steps. The carton blank is then conveyed to carton-forming station 240. The completed carton 216 then exits apparatus 210, being transported by outlet conveyor 242 shown at the bottom corner of FIG. 6.

As will be seen herein, it is preferred that the blank being processed in apparatus 210 receive various applications of adhesive prior to the blank being folded and overlapping portions of the blank pressed together to complete an adhesive joining process. Referring again to FIGS. 5 and 6, a first pair of adhesive applicators 246 is located between loading station 220 and corner post-forming station 230. With reference to FIG. 3, the adhesive applicators 246 apply adhesive to blank portion 78, 82 and 86, 90, which is used in the corner post-forming station to form the corner posts 202 shown, for example, in FIG. 4.

A downstream adhesive applicator 248 applies adhesive to beam portion 206, and with reference to FIG. 3, the applied adhesive is shown on blank portions 60*a*, 42*a*, and 62*a*. The partially formed blank 200 then enters internal beam-forming station 32, shown in greater detail in FIGS. 7–9.

Figure 7:
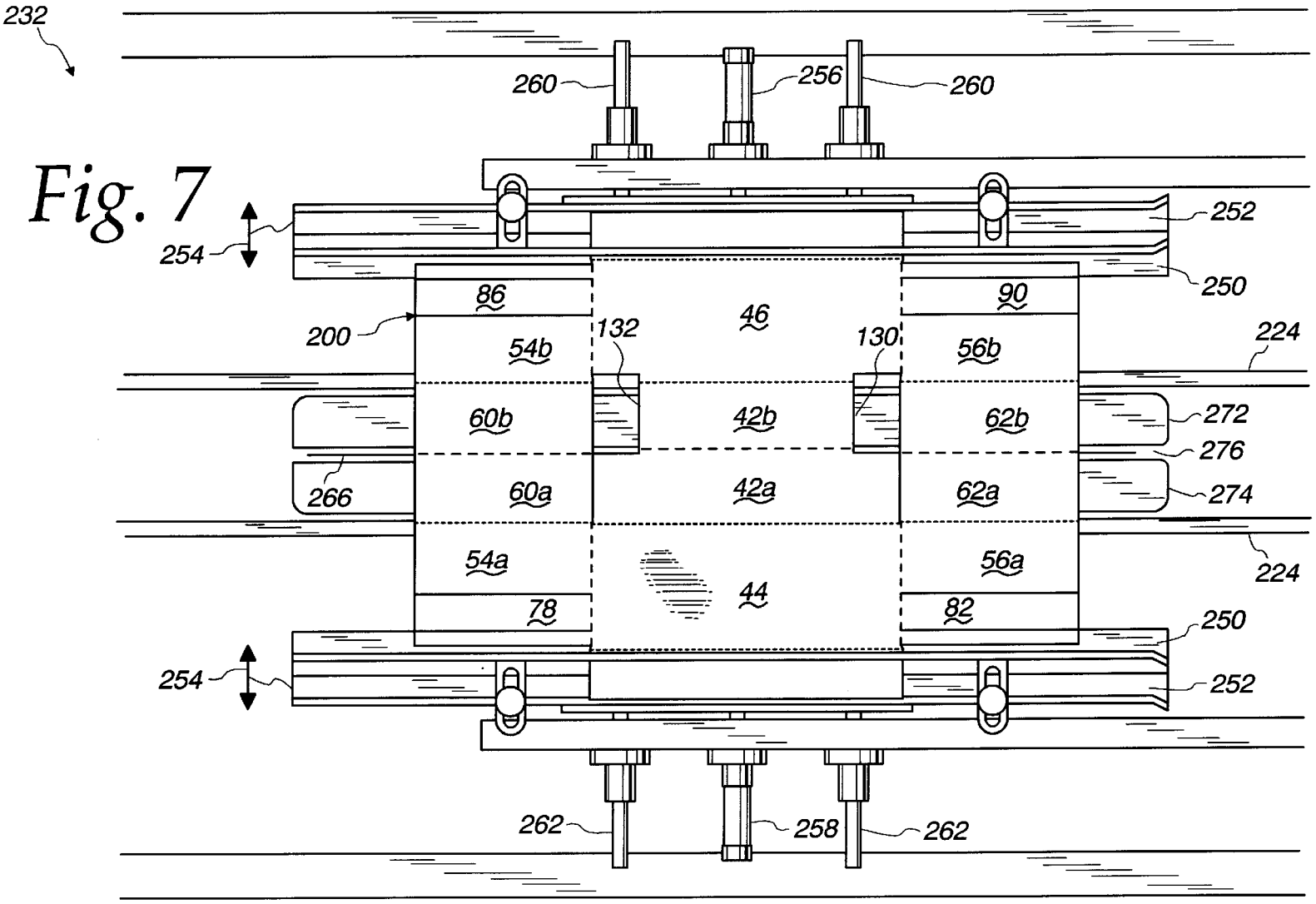
FIG. 7 is a top plan view of blade apparatus according to principles of the present invention.
Figure 8:
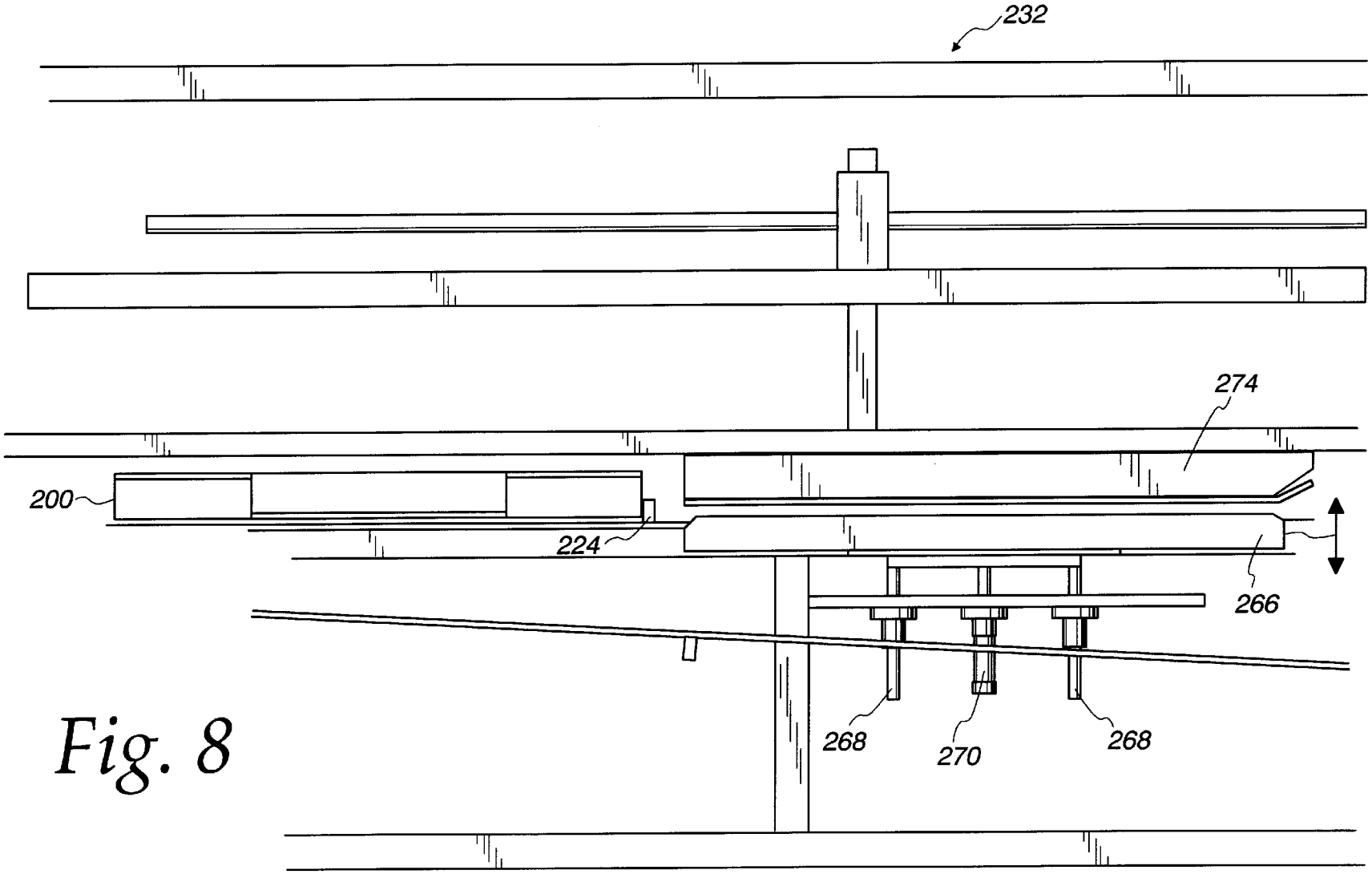
FIG. 8 is a side view thereof.

Referring now to FIGS. 7–9, internal beam-forming station 232 includes inner and outer guide rails 250, 252 which preferably are mounted together for co-ordinated movement in the direction of arrows 254. The rails on either side of the machine center line are moved toward and away from each other under operation of pneumatic cylinders 256, 258, traveling along slide members 260, 262, respectively. Referring to FIG. 8, the internal beam-forming station includes a blade 266 having a length extending in the feed direction mounted on slide supports 268 for movement in vertical directions via operation of pneumatic operator 270. A pair of supports identified by reference numerals 272, 274 are located on either side of blade 266, and are spaced apart, as can be seen in FIG. 7, so as to form a blade-receiving gap 276 therebetween. As can be seen in FIG. 9, the supports 272, 274 are located on either side of blade 266, beneath the path of travel of the partially formed blank 200. As can be seen in FIG. 9*a*, a form 288 having walls 282, 284 is located on top of the partially formed blank. If desired, the support walls 282, 284 may be formed separate from one another, each being generally L-shaped in cross-section. However, with reference to FIGS. 9*a*–9*d*, the support walls 282, 284 are preferably joined together so as to be conveniently formed from a single piece of sheet metal, folded to have a W-shape in cross-section.

Figure 9A:
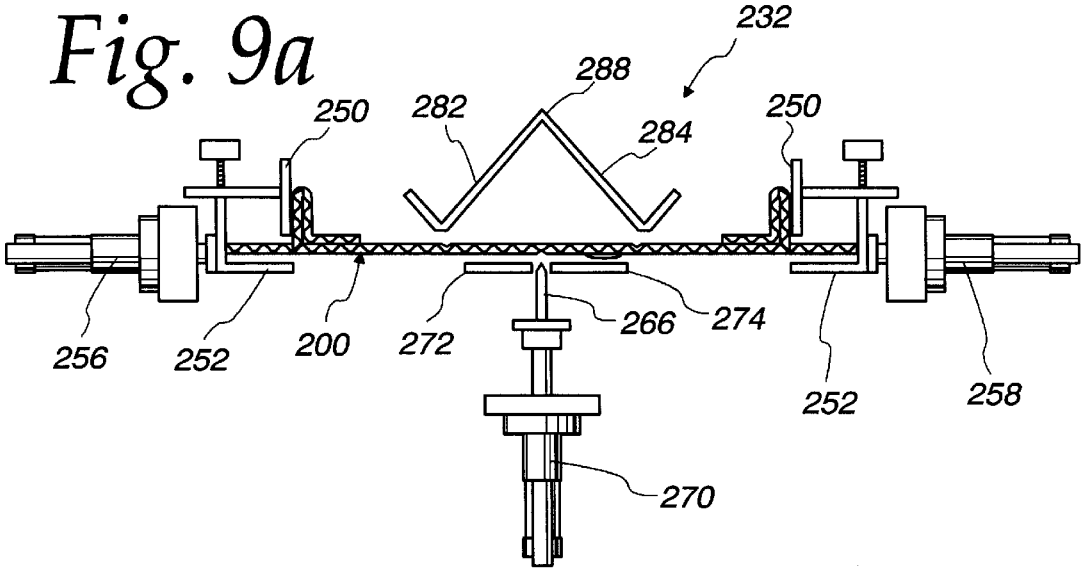
FIGS. 9*a*–9*d* are fragmentary cross-sectional views taken along the line 9—9 of FIG. 5, and showing a sequence of assembly operation.
Figure 9B:
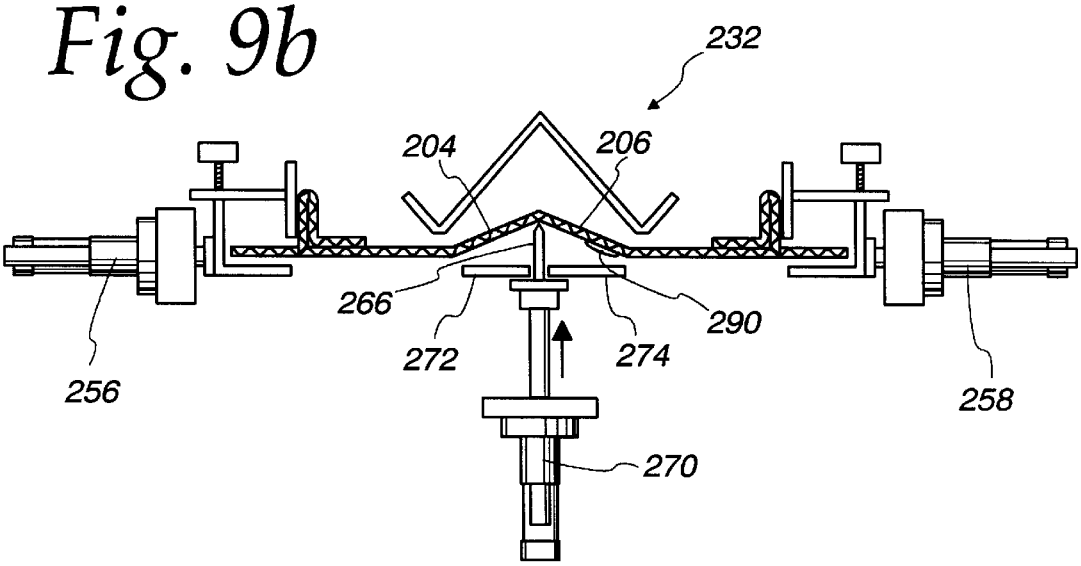

Referring now to FIGS. 9*a*–9*d*, the preferred sequence of operation of the internal beam-forming station begins with reception of partially formed blank 200 at station 232. Operators 256, 258 move the guide rails 250, 252 to confine the opposed outer edges of a partially formed blank, and optionally to also lightly engage the corner post in the manner indicated in FIG. 9. Operator 270 is then energized to raise the blade 266, causing the internal beam portions 204, 206 of the partially formed blank to be raised above the horizontal plane, as shown in FIG. 9*b*. With brief reference to FIG. 2, the internal beam portions are divided into three segments, identified by reference numerals 60, 46 and 62. This action causes the width of the partially formed blank to contract, as shown in FIG. 9*b*.

Figure 9C:
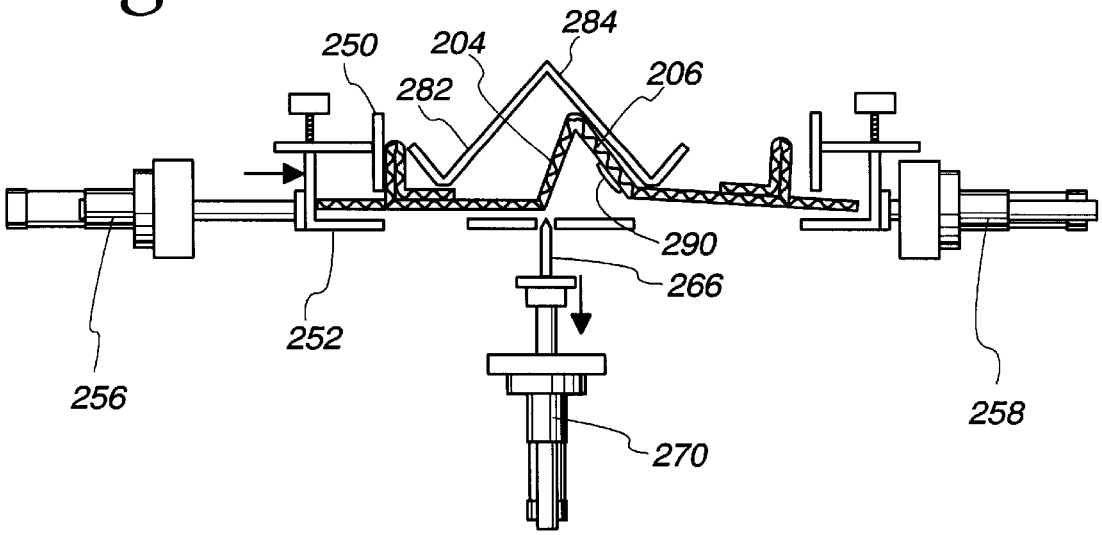
Figure 9D:
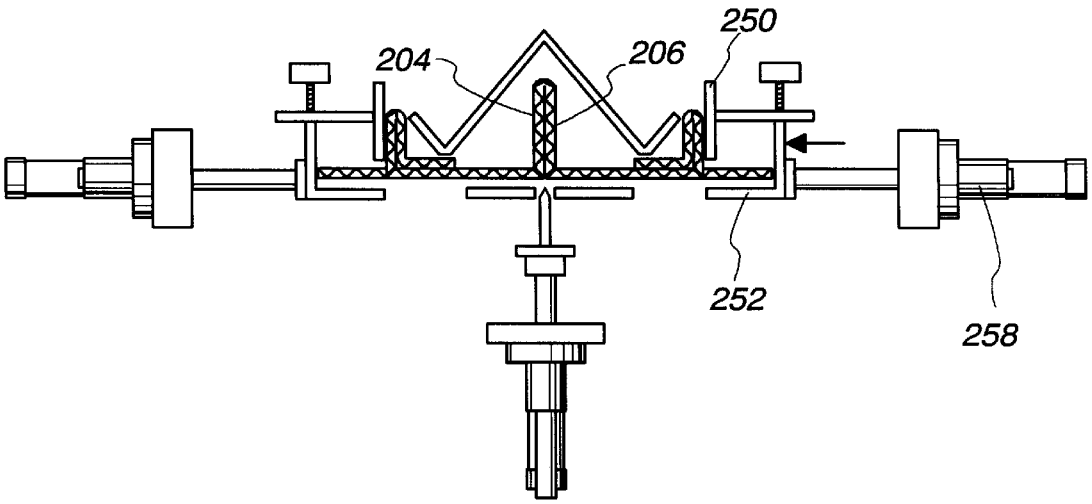
Figure 10:
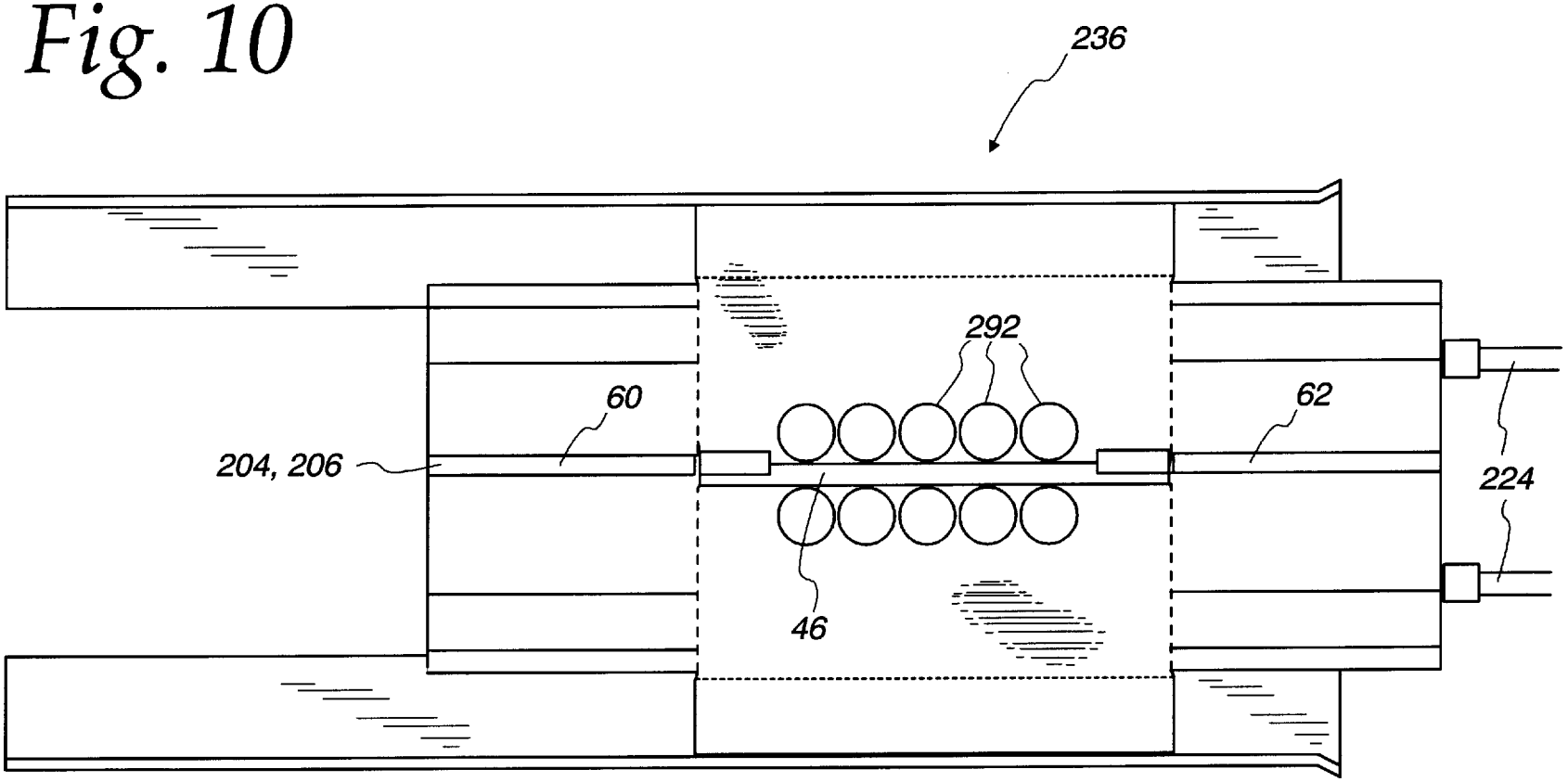
FIG. 10 is a top plan view of a sealing and feeding station according to principles of the present invention.

As shown in the figures, it is preferred that only the internal beam portion 206 have adhesive applied to it, in preparation for formation of the triple segment internal beam of carton 216. The adhesive portion referred to is indicated by reference numeral 290. This can be seen, for example, in FIGS. 9*b* and 9*c*. As indicated in FIG. 9*c*, operator 270 is actuated to retract blade 266 below the carton blank. Actuator 256 is then energized to move its associated guide rails 250, 252 toward the center line of the carton blank, compressing the blank and causing internal beam portion 206 to press against form wall 284. As indicated in FIG. 9*d*, the guide rails associated with operator 256 remain in contact with one edge of the carton blank while operator 258 is energized to move its associate guide rails toward the center line of the blank, thus compressing the blank further and causing internal beam portions 204, 206 of the carton to come together in overlying relationship. The operators 256, 258 are then retracted, and the carton blank is advanced toward sealing station 236, where the overlying internal beam portions 204, 206 are passed through a series of pressure rollers 292 to complete the bond of the internal beam sections. With brief reference to FIG. 6, the carton blank is then transferred from chain conveyor 224 to a web conveyor 300.

Figure 11A:
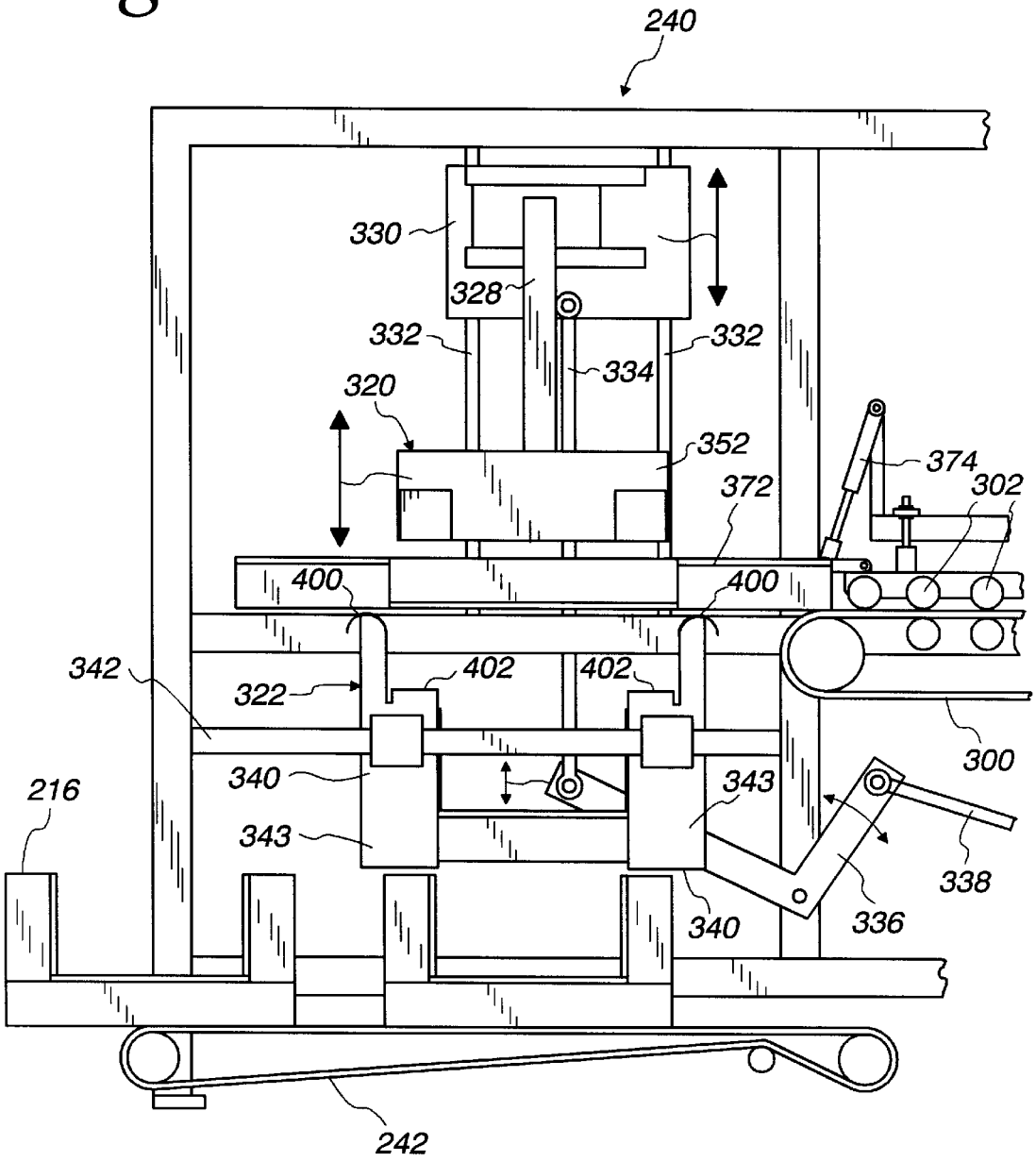
FIGS. 11*a*–11*c* are side elevational views of a head assembly station according to principles of the present invention.

With additional reference to FIG. 11*a*, belt 300 is located immediately upstream of carton-forming station 240. A roller train 302 is located above conveyor belt 300 to control the orientation of the carton blank, and to provide additional feed pressure. Referring again to FIG. 5, further amounts of adhesive are applied to the carton blank, prior to entry of the blank at carton-forming station 240. A central adhesive applicator 304 and outer adhesive applicators 306, 308 are located immediately downstream of the pressure rollers 292. Referring to FIG. 3, the central adhesive applicator 304 applies adhesive portions 310, 312 to the upstanding blank portion 42*a*, which is exposed by apertures 130, 132 formed in the carton blank, to allow adhesive to be sprayed in the horizontal direction, since the blank portions 42*a*, 42*b* are, by this time, pressed together in overlying relationship to form the upstanding beam segment 46. The outer adhesive applicator 305 applies adhesive to blank part 52*a* while the remaining adhesive applicator 308 applies adhesive to blank part 50*a*. The blank is then conveyed to carton-forming stations 240.

Referring now to FIGS. 11*a*–11*c* and 12*a*–12*e*, carton-forming apparatus at station 240 includes a forming mandrel generally indicated at 320 and a hollow form assembly generally indicated at 322. Referring briefly to FIG. 5, the central portion of the carton blank is located underneath the forming mandrel 320, with portions of the carton blank extending on the upstream and downstream sides of the forming mandrel. This portion of FIG. 5 is shown on a large scale in FIG. 12*f*, where it can be seen that the forming mandrel 320 has a dimension generally corresponding to the central internal beam part 46, so that the remaining internal beam parts 60, 62 are disposed outside of the forming mandrel.

With reference again to FIG. 5, the forming mandrel 320 is supported by a generally L-shaped cantilevered support arm 328, attached at one end to the forming mandrel 320, and at the other end to a mounting bracket 330. Mounting bracket 330 is in turn mounted on slide supports 332 for up and down movement, as indicated by the double-headed arrows in FIGS. 11*a*–11*c*.

Referring again to FIG. 11*a*, mounting bracket 330 is connected to linkage including link arm 334, crank arm 336 and link arm 338. Referring to FIG. 6, link arm 338 is connected through gear box 340 to drive motor 342. Gear box 340 preferably includes additional linkage such that the right hand of the link arm 338 is made to travel in a circular pattern, is indicated in dash lines in FIG. 6. Forming mandrel 320 undergoes a corresponding vertical reciprocation, with each operating cycle associated with the formation of a completed carton 216. The hollow form assembly 322 includes an opposed pair of concave wall members 340 which are mounted on support 342 for movement toward and away from each other. The form members 340 are preferably U-shaped in cross-section, and are dimensioned for a close tolerance fit with the completed carton 216, so as to effectively function as a form against which the carton blank can be pressed during operation of the carton forming apparatus.

Referring to FIGS. 12*a*–12*f*, the forming mandrel 320 preferably includes a hollow body 346 having an upper wall 348 joined to cantilever support arm 328. Hollow body 346 further includes a pair of opposed side walls 350, 352 forming four outside corners and an internal support wall 354. In the preferred embodiment, six pneumatically operated cylinders are employed to press overlying carton layers together to form an adhesive joint. With brief reference to FIG. 2, the six adhesive joints are located at the bottom of the carton, where overlying vertical and horizontal members meet. For example, a first pair of joints is located along side wall 50, where the side wall overlaps wall members 66, 68. A corresponding pair of joints are located at the other side of the carton. The remaining pair of joints are located in the interior of the carton, where internal beam member 42 overlies the bottom portions of the beam members 60, 62.

As mentioned above, adhesive has been applied to the carton blank in advance, and the pistons employed within the forming mandrel press the joints of overlying material together. For example, with reference to FIG. 12*f*, a first pair of pistons 356, 358 join panel 50*a* to the bottom ends of panels 68, 66, respectively, with the walls of retaining members 340 providing support "back up" for the pistons 356, 358 and with opposed walls of forming members 340 "backing up" pistons 360, 362. A second pair of pistons 360, 362 joins wall panel 52 to the lower ends of panel 72, 70, respectively. A remaining pair of pistons 364, 366 presses the internal center beam part 46 against the lower portions of internal beam parts 60, 62, with support or "back up" for the pistons 364, 366 being provided by internal support wall 354.

FIG. 14 shows in schematic form, the forming operations performed on the carton blank 200. FIG. 14*a* shows the forming mandrel in the position illustrated in FIG. 12*a*, beginning a downward descent to engage the central portion of the carton blank. In FIG. 14*b*, the forming mandrel (not shown) presses the central portion of the carton blank into the hollow form. As outlying portions of the carton blank engage rounded ends 400 of the opposed hollow form members, raising of the outlying portions of the carton blank is begun. At the same time, the internal beam part is deflected from a vertical position, clearing the internal beam parts which have begun to be raised in a vertical direction. In FIG. 14*c*, raising of the carton side walls is completed, with the outer internal beam parts being raised to a vertical position. The central part of the internal beam is then pressed into position as indicated by the arrow. In FIG. 14*d*, formation of the carton is complete.

Figure 11B:
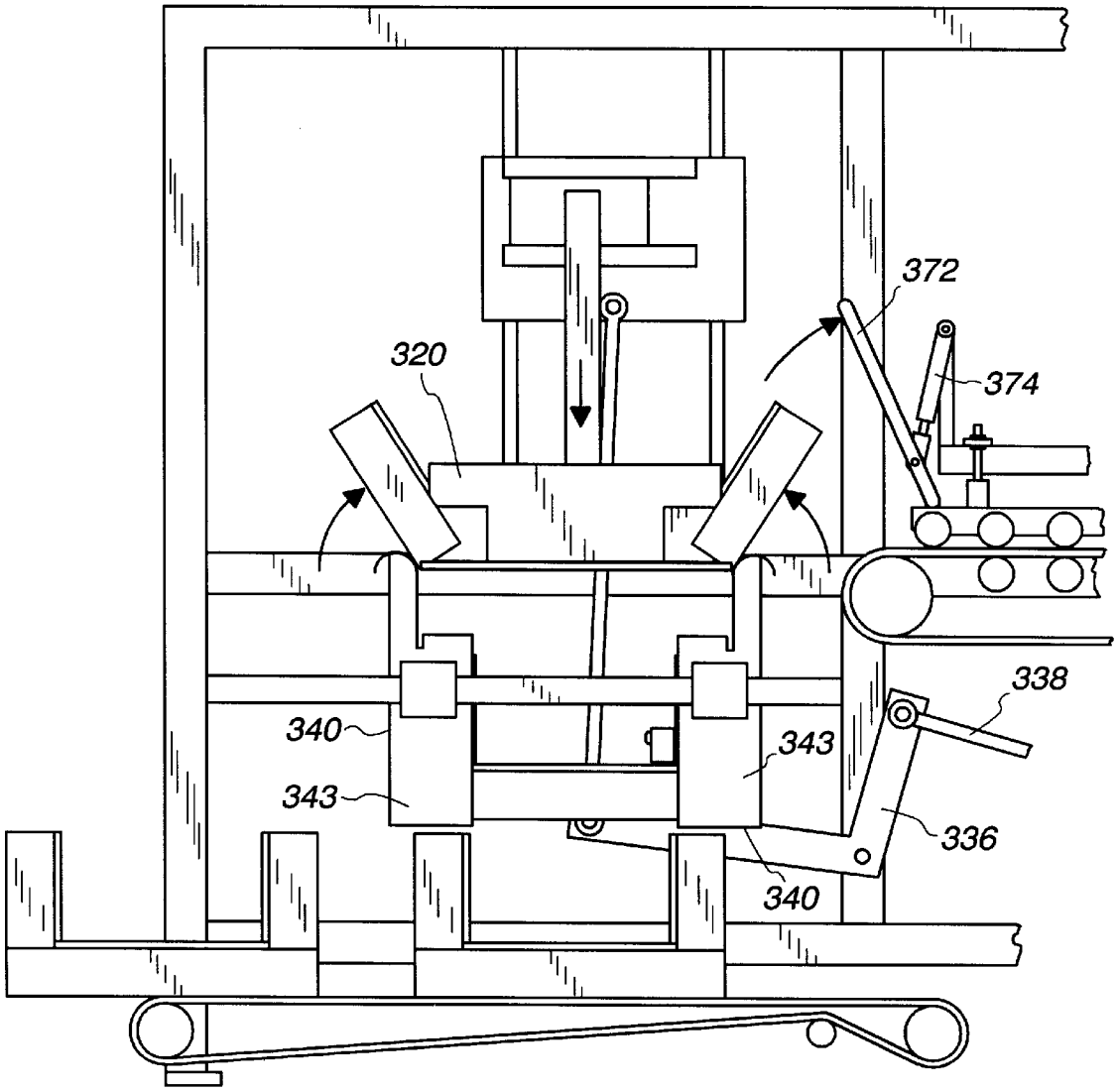
Figure 11C:
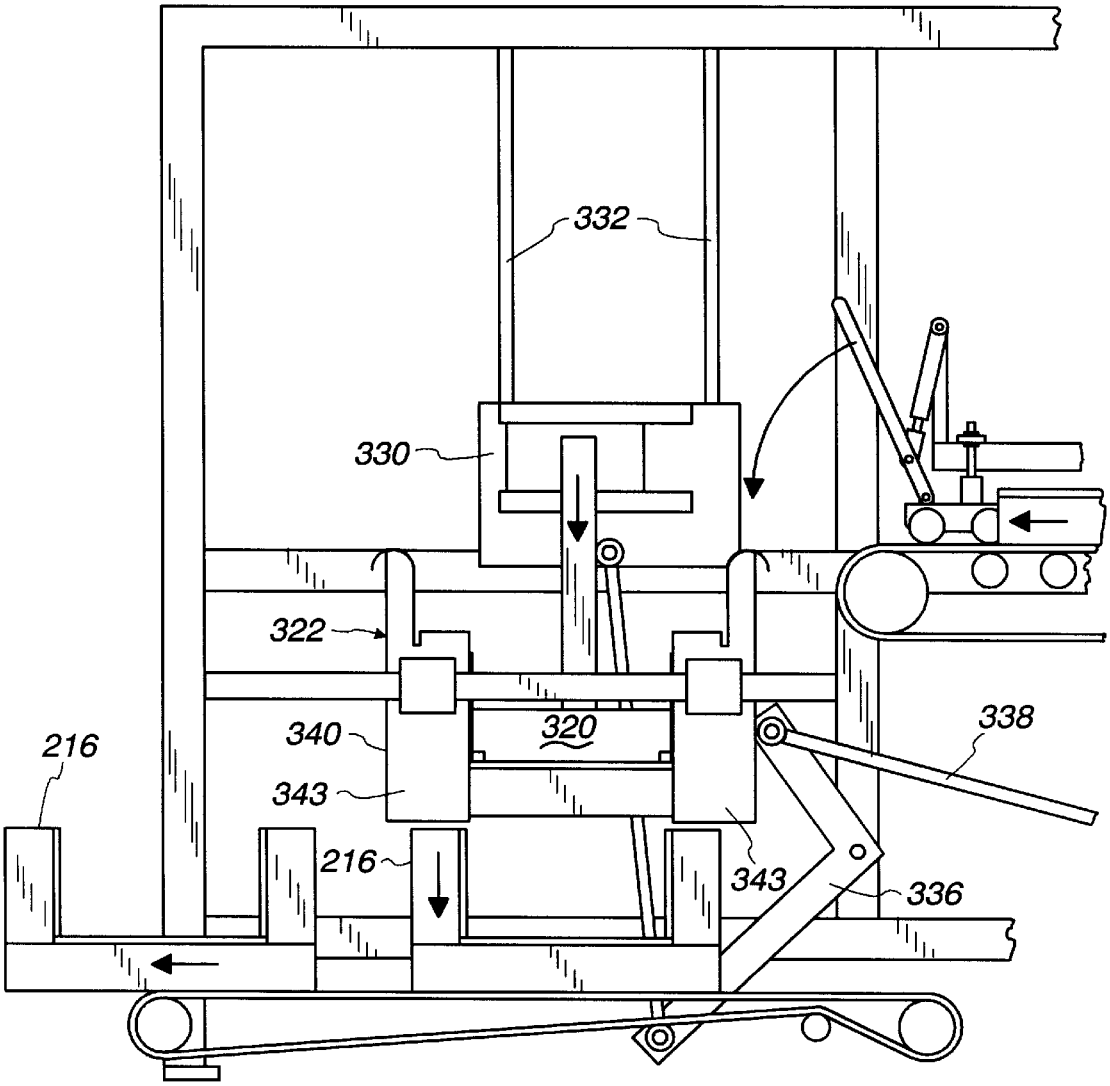
Figure 12A:
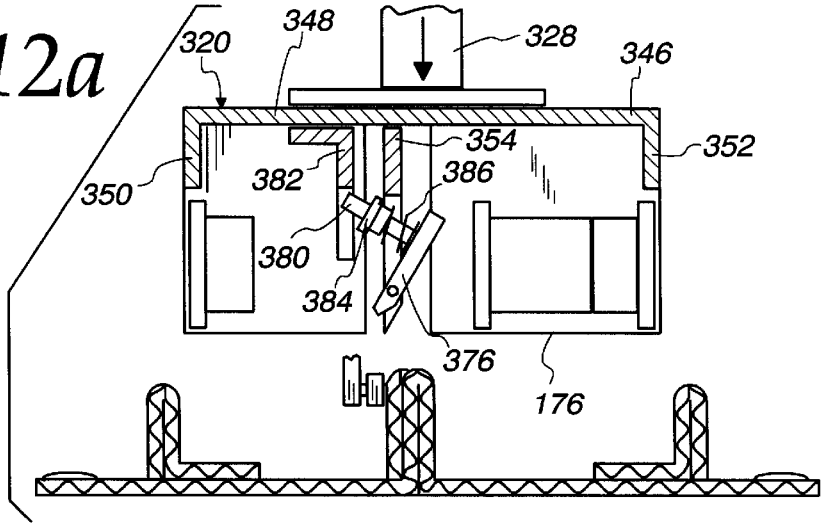
FIGS. 12*a*–12*e* are cross-sectional views of the head assembly showing various stages of progression through its operating cycle, with FIG. 12*a* being a cross-sectional view along the line 12*a*—12*a* of FIG. 11*a* and FIG. 12*b* being a cross-sectional view along line 12*b*—12*b* of FIG. 11*b*, and with FIGS. 12*c*–12*e* showing subsequent stages of operation.
Figure 12B:
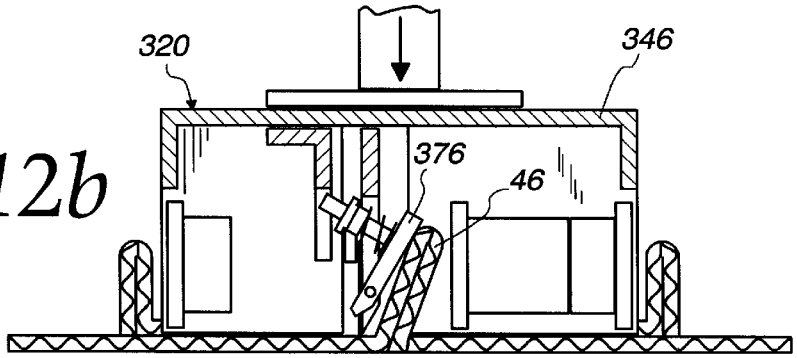
Figure 12C:
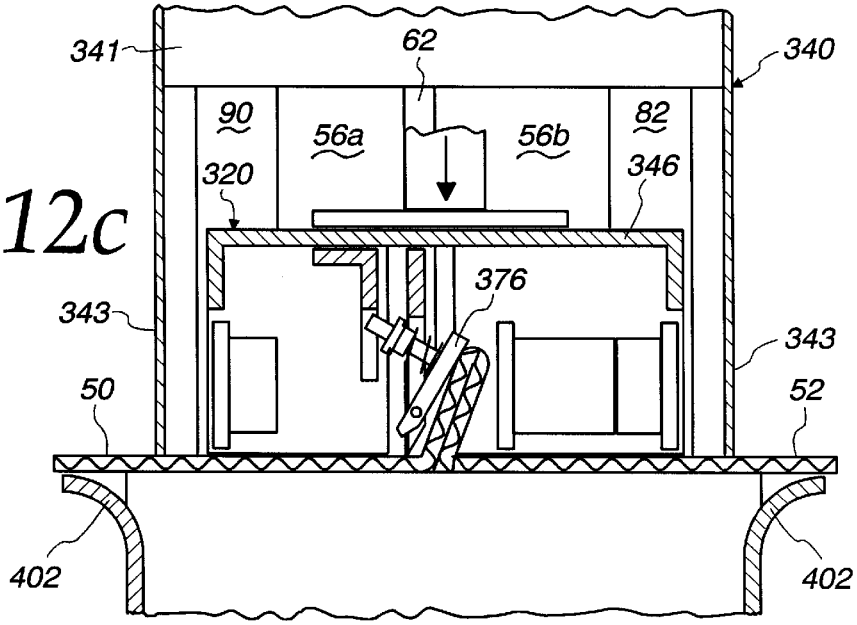
Figure 12D:
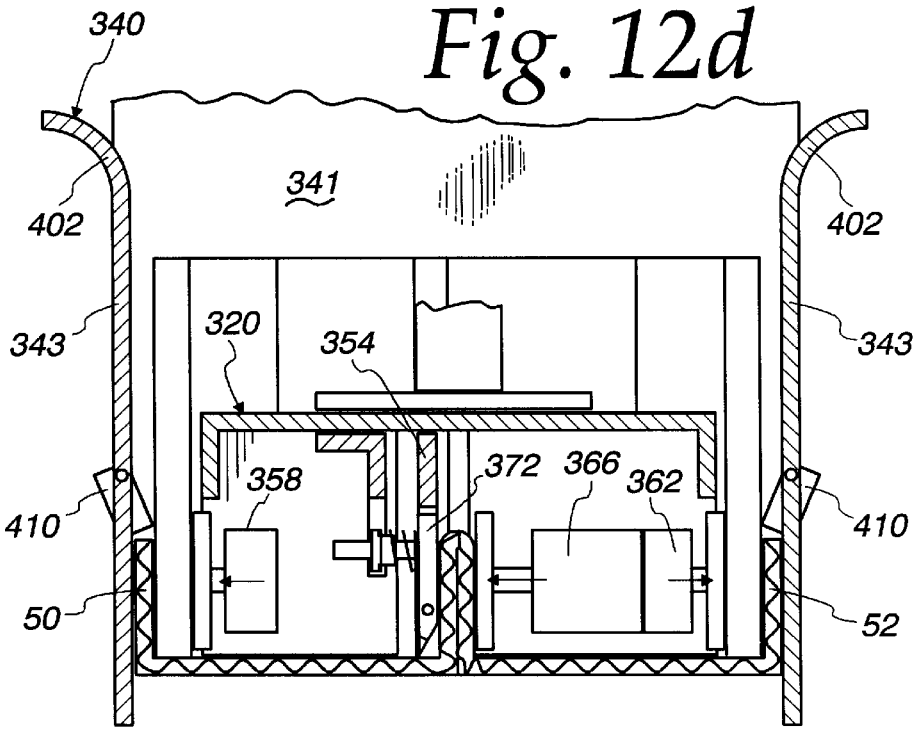
Figure 12E:
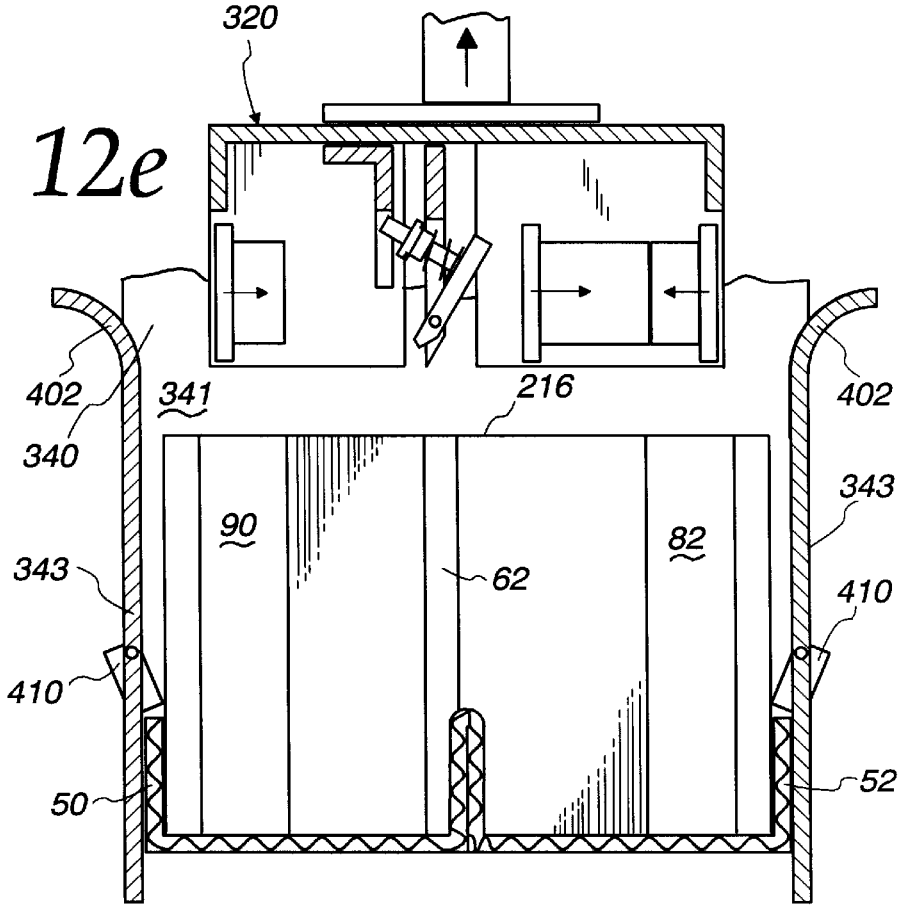
Figure 12F:
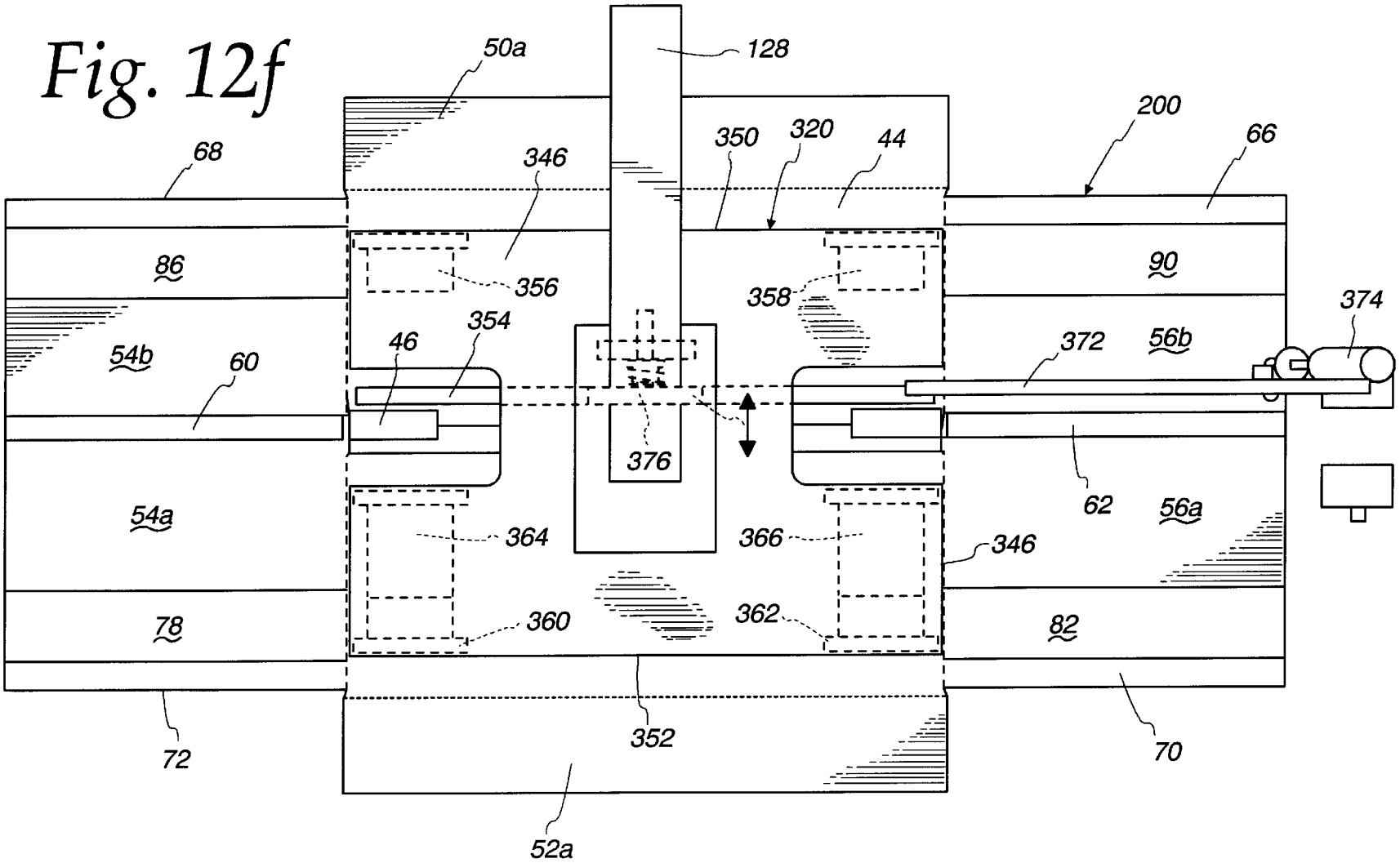
FIG. 12*f* is a top plan view of the head assembly.

With reference now to FIGS. 11*a*–11*c* and 12*a*–12*f*, operation of forming apparatus will now be described. As a carton blank travels from sealing station 236 to forming station 320, the forming mandrel 320 is located in a raised position as indicated in FIGS. 11*a* and 12*a*. A guide finger 372 has been lowered into position by operation of air cylinder 374. The guide finger 372 holds the internal beam members in an upward position in preparation for operation of the forming mandrel. The guide finger 372 is optional, and has not been found to be necessary with certain grades of paperboard material. However, due to the asymmetry of the paperboard blank (and particularly the apertures 130, 132 as can be seen in FIG. 3), certain grades of paperboard material cause uneven stresses in the internal beam, resulting in the internal beam (or at least the center portion thereof) drifting or heeling over away from a desired vertical position.

Referring now to FIGS. 11*b* and 12*b*, forming mandrel 320 is lowered, with the bottom end 176 of mandrel body 346 (see FIG. 12*a*) contacting the carton blank as illustrated in FIG. 12*b*. A deflecting wall 376 is pivotally connected at one end to internal support wall 354 and is pivotally connected at its other end through arm 380 to a slot formed in L-shaped wall 382. The arm 380 carries a stop member 384 slidably mounted on arm 380. A spring 386 biases stop member 384 away from the deflecting wall 376. The stop member 384 is dimensioned so as to interfere with support wall 382, causing spring 386 to be compressed as deflecting wall 376 is made to rotate in a counterclockwise direction (i.e. counterclockwise with reference to the illustration shown in FIGS. 12*a*–12*e*).

As forming mandrel 320 is lowered into contact with the carton blank, as illustrated in FIG. 12*b*, the deflecting wall 376 causes the central part 46 of the internal beam to "heel over" away from a vertical position clearing the central internal beam for movement of the outer internal beam parts 60, 62 as they are raised into a vertical position, partly overlying the ends of central part 46. As mentioned, adhesive has been previously applied to central part 46, and deflecting wall 376 ensures that the adhesive will not be inadvertently displaced as the walls of the carton blank are raised into position by operation of the forming mandrel. FIG. 12*c*shows the forming mandrel partly lowered into the hollow form assembly 322.

With reference FIG. 11*a*, the concave wall members 340 are generally U-shaped in cross-section, with an intermediate bight wall 341 having an upper rounded end 400, the bight wall being located between stepped side walls 343 having upper rounded ends 402 which are also visible in FIG. 12*c*. In FIG. 12*c*, the side walls of the carton have been raised to a vertical orientation as shown in the figure. The walls 50, 52 have not yet been raised to a vertical position, and accordingly remain in a horizontal plane.

Referring now to FIG. 12*d*, lowering of the forming mandrel 320 continues with the side walls 50, 52 being brought to a vertical position. As mentioned, the carton blank has previously received applications of adhesive for joining of portions of the carton which are subsequently brought into overlying relationship. As mentioned, the overlying relationships of various portions of the carton have been completed at the time indicated in FIG. 12*d*. However, in order to ensure a high strength bond at the various joints, the joints are compressed with the aforementioned pistons contained in the forming mandrel.

As indicated in FIG. 12*d*, the pistons are preferably operated at the same time to press six joints at the bottom of the carton together. As indicated in FIG. 12*d*, operation of air cylinder 366 causes deflecting wall 376 to assume a vertical position. The pistons 364, 366 are, however, "backed up" by internal support wall 354. At the conclusion of the step illustrated in FIG. 12*d*, the carton is fully formed and preparation is made to withdraw the forming mandrel to assume the position illustrated in FIG. 12*a*, ready for subsequent cycles of operation. In some situations, the forming mandrel may not be cleanly "stripped" from the carton due to frictional engagement between the forming mandrel and the carton walls. Accordingly, stripper pins are mounted in the opposed walls of hollow forms 340. As illustrated, the stripper pins 410 engage the upper edges of side walls 50, 52, preventing the carton from being raised as the forming mandrel 320 is withdrawn. In the preferred embodiment, the carton 216 remains in the hollow form, until a subsequent operation pushes the next carton blank into the hollow form, thereby forcing the previously formed carton to drop out of the hollow form, onto conveyor 242, as illustrated in the bottom of FIG. 11.

Figure 13A:
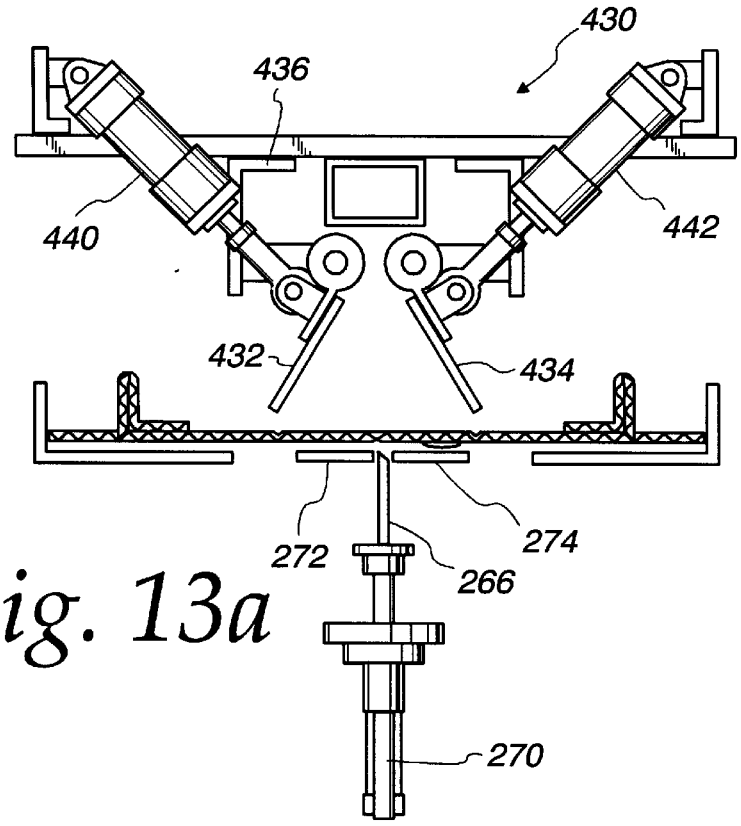
FIGS. 13*a*–13*d* are cross-sectional views similar to those of FIGS. 9*a*–9*d* but showing an alternative beam-forming apparatus.
Figure 13B:
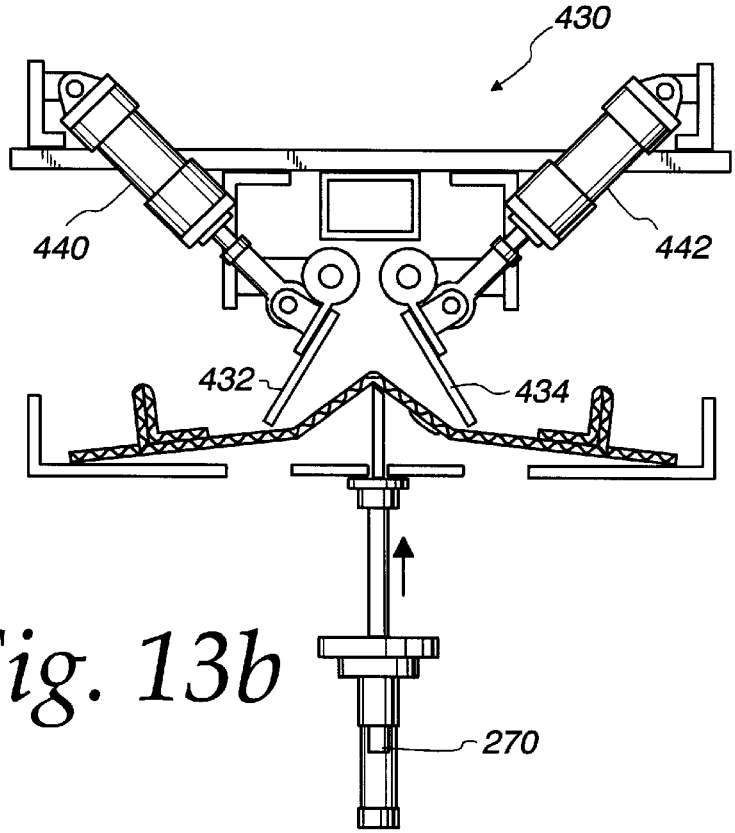
Figure 13C:
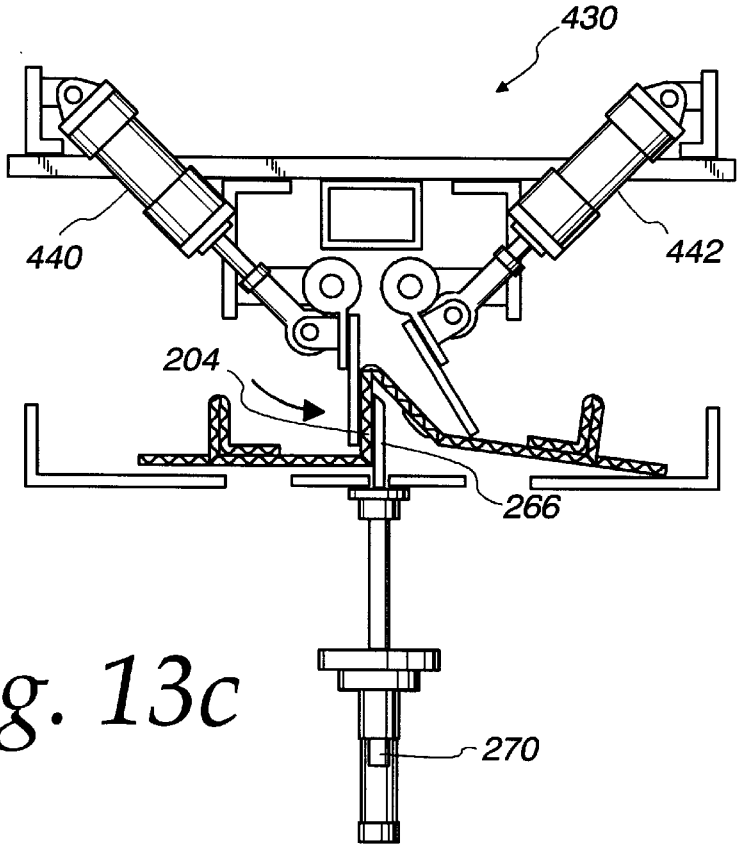
Figure 13D:
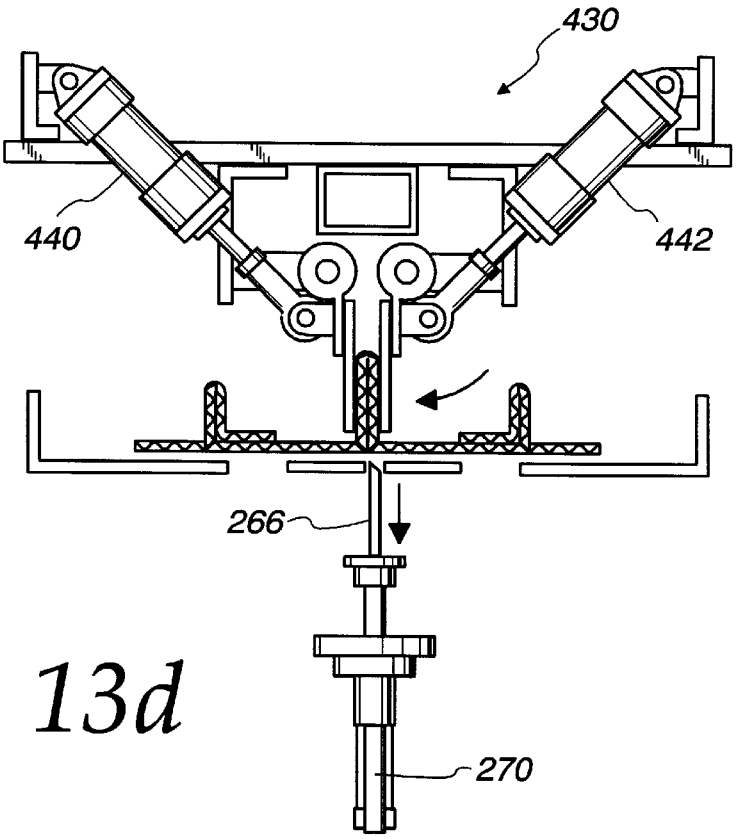
Figure 14A:
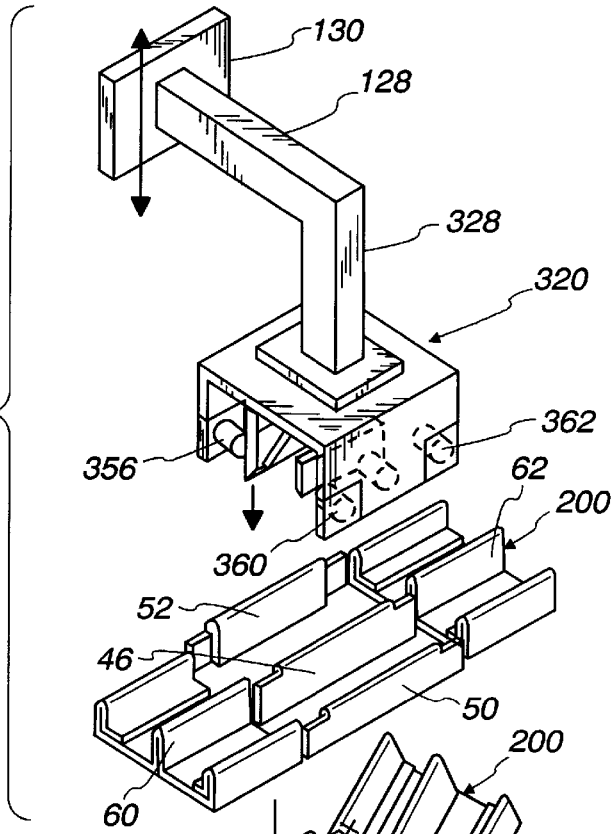
FIGS. 14*a*–14*d* are schematic perspective views showing steps of assembling the carton apparatus.
Figure 14B:
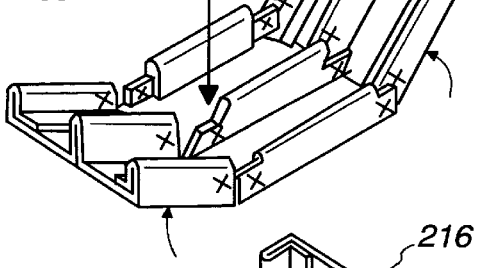
Figure 14C:
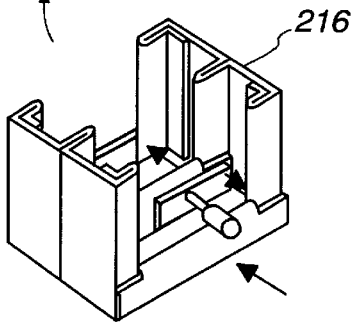
Figure 14D:
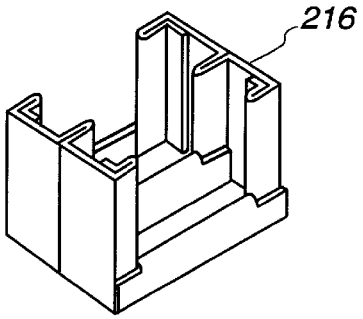

Turning now to FIGS. 13*a*–13*d*, an alternative embodiment of the internal beam forming apparatus is generally indicated at 430. In the first-mentioned beam-forming apparatus illustrated in FIGS. 7–9, blade 266 raises the carton blank, breaking the central score line, and this feature is repeated in alternative embodiment of beam-forming apparatus 430. However, whereas the previously mentioned beam-forming apparatus provided a form 288 with walls 282, 284 (see FIG. 9*a*–9*d*) the alternative embodiment of beam-forming apparatus 430 uses movable forming walls 432, 434 pivotally mounted to an upper support structure 436. The movable walls 432, 434 are independently actuated by pneumatic cylinders 440, 442, which are also supported from structure 436. After the central score line is broken, as indicated in FIG. 13*b*, the blade 266 remains in an elevated position as cylinder 440 is operated to move wall 432 so as to compress beam portion 204, as illustrated in FIG. 13*c*. The cylinders 270, 442 are then actuated in the manner illustrated in FIG. 13*d* to compress the beam portions 204, 206 together, thus achieving an initial formation of the internal beam. If desired, the compressive force applied to walls 432, 434 can be increased to eliminate the need for subsequent pressing at the sealing station.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for forming a carton from a paperboard blank having an interior portion with first and second parts and four outside corners, the apparatus comprising:

a conveyor for moving the blank along a direction of travel;

a blade on one side of the conveyor and having a length extending along the direction of travel, the blade movable toward and away from a blank carried on the conveyor;

means for moving the blade to push the interior portion of the blank, bringing the parts of the interior portion of the blank into overlying relationship;

a sealing section adjacent the conveyor for pressing the overlying parts together;

a carton-forming station;

a hollow form at the carton-forming station, on one side of the conveyor means, the hollow form defining a passageway for receiving a forming mandrel;

a forming mandrel at the carton-forming station, on the other side of the conveyor means, opposite the hollow form, the forming mandrel mounted for movement toward and away from the hollow form; and mandrel operating means for pushing the forming mandrel into the hollow form to thereby plunge the blank into the hollow form.

2. The apparatus of claim 1 wherein the hollow form includes a pair of opposed concave wall members.

3. The apparatus of claim 2 wherein the wall members are generally U-shaped in cross-section.

4. The apparatus of claim 1 wherein the forming mandrel includes a plurality of pistons for pressing portions of the blank against the hollow form.

5. The apparatus of claim 4 wherein the blank includes an upstanding internal wall and the forming mandrel further includes a deflecting member for deflecting the internal wall of the blank as the forming mandrel is brought into engagement with the blank.

6. The apparatus of claim 1 further comprising compressing means on either side of the blank, movable toward one another to compress the blank, reducing its width and bringing overlying parts together in preparation for entering the sealing section.

7. The apparatus of claim 1 wherein the internal beam has multiple sections arranged end-to-end on the blank, the multiple sections associated with side walls and bottom of the carton, the forming mandrel includes a second plurality of pistons for pressing parts of the multiple sections of the internal beam against one another.

8. The apparatus of claim 1 further comprising slide supports located on one side of the conveyor means, and the forming mandrel is cantilevered from the slide supports as it is moved toward and away from the blank.

9. The apparatus of claim 1 further comprising adhesive applicator means for applying adhesive to the blank prior to entry of the blank at the carton forming station, the pistons of the forming mandrel pressing first parts of the blank containing adhesive with second parts of the blank to join first and second parts of the blank together with adhesive.

10. The apparatus of claim 1 wherein the sealing section comprises a support and an opposed pair of sealing flaps hingedly mounted from the support for independent movement toward and away from each other.

11. The apparatus of claim 10 wherein the blade is positioned between the sealing flaps so that at least one sealing flap can press one of the overlying parts of the carton blank against the blade.

12. The apparatus of claim 11 further comprising adhesive sealing means for applying adhesive to the blank prior to movement of the blade, so that movement of the sealing flaps together causes adhesive joinder of the overlying parts of the blank.

13. A forming mandrel for forming a carton having a floor with an upstanding internal beam extending away from the floor, from a paperboard blank which has an interior portion, the apparatus comprising:

a hollow body having a plurality of outside corners and an interior;

a first plurality of pistons within the hollow body, adjacent the outside corners;

a second plurality of pistons in the interior portion of the hollow body for compressing the upstanding portion of the carton blank; and a deflecting member in the interior portion of the hollow body for selectively deflecting the upstanding portion of the carton blank toward the floor.

14. The forming mandrel of claim 13 wherein the hollow body is double ended and the deflecting member comprises an arm pivotally mounted at one end of the deflecting member.

15. The forming mandrel of claim 13 wherein the first plurality of pistons includes two pairs of pistons, each pair aligned along respective first and second generally parallel lines.

16. The forming mandrel of claim 13 wherein the second plurality of pistons includes a pair of pistons aligned along a line generally parallel to the first and second lines.

17. The forming mandrel of claim 13 further comprising cantilever mounting means for supporting the hollow body.

18. A forming mandrel assembly for forming a carton having a floor with an upstanding internal beam extending away from the floor, from a paperboard blank which has an interior portion and four outside corners, the apparatus comprising:

a forming mandrel end:

a hollow body having a plurality of outside corners and an interior;

a first plurality of pistons within the hollow body, adjacent the outside corners;

a second plurality of pistons in the interior portion of the hollow body for compressing the upstanding portion of the carton blank; and a deflecting member in the interior portion of the hollow body for selectively deflecting the upstanding portion of the carton blank toward the floor;

the apparatus further comprising:

a hollow form-defining a passageway for receiving a forming mandrel and cooperating with the first plurality of pistons to compress portions of the blank together.

* * * * *